US009417027B2

(12) United States Patent
Meilak

(10) Patent No.: US 9,417,027 B2
(45) Date of Patent: Aug. 16, 2016

(54) ARCHERY TORQUE REDUCTION GRIP APPARATUS, SYSTEM AND METHOD

(71) Applicant: Anthony Meilak, Altamont, NY (US)

(72) Inventor: Anthony Meilak, Altamont, NY (US)

( * ) Notice: Subject to any disclaimer, the term of this patent is extended or adjusted under 35 U.S.C. 154(b) by 0 days.

(21) Appl. No.: 14/566,898

(22) Filed: Dec. 11, 2014

(65) Prior Publication Data

US 2015/0090239 A1 Apr. 2, 2015

Related U.S. Application Data

(60) Provisional application No. 61/915,697, filed on Dec. 13, 2013.

(51) Int. Cl.

| | |
|---|---|
| ***A41B 5/00*** | (2006.01) |
| ***F41B 5/00*** | (2006.01) |
| ***F41B 5/14*** | (2006.01) |
| *F41B 5/10* | (2006.01) |

(52) U.S. Cl.

CPC ..... *F41B 5/0031* (2013.01); *F41B 5/14* (2013.01); *F41B 5/1426* (2013.01); *F41B 5/10* (2013.01)

(58) Field of Classification Search

CPC ..... A41B 58/14; A41B 5/0031; A41B 5/10
USPC ..... 124/23.1, 25.6, 86, 88, 89
See application file for complete search history.

(56) References Cited

U.S. PATENT DOCUMENTS 2,854,965 A * 10/1958 Eberbach ..... F41B 5/0073 124/23.1
3,040,728 A 6/1962 Nieman
3,397,685 A * 8/1968 Walker ..... F41B 5/0005 124/23.1
3,407,799 A * 10/1968 Bennett ..... F41B 5/0005 123/47 R
3,416,508 A * 12/1968 Thompson ..... F41B 5/0073 124/24.1
3,468,297 A 9/1969 Cress
3,491,739 A * 1/1970 Scrobell ..... F41B 5/0031 124/23.1
3,517,658 A * 6/1970 Shurts ..... F41B 5/0005 124/23.1
3,538,902 A * 11/1970 Fowkes ..... F41B 5/0031 124/23.1
3,599,621 A * 8/1971 Scrobell ..... F41B 5/0031 124/23.1
3,814,074 A * 6/1974 Wood ..... F41B 5/0005 124/88
4,175,536 A * 11/1979 Carella ..... F41B 5/14 124/23.1
4,252,100 A * 2/1981 Rickard ..... F41B 5/10 124/23.1
4,457,287 A * 7/1984 Babington ..... F41B 5/10 124/23.1
4,787,361 A * 11/1988 Vyprachticky ..... F41B 5/14 124/24.1
4,966,124 A * 10/1990 Burling ..... F41B 5/14 124/23.1
5,081,979 A * 1/1992 Burling ..... F41B 5/14 124/23.1
5,241,945 A * 9/1993 Shepley, Jr. ..... F41B 5/0031 124/23.1
5,243,958 A * 9/1993 Shepley, Jr. ..... F41B 5/0031 124/23.1

(Continued)

*Primary Examiner* — Alexander Niconovich
(74) *Attorney, Agent, or Firm* — Jay R. Yablon

(57) ABSTRACT

An archery bow system apparatus and related methods for reducing bow torque, comprising: an outer bow grip; an inner bow handle enclosed by the outer bow grip; wherein: when the bow system is in an undrawn state, the outer bow grip is prevented from rotating relative to the inner bow handle; and when the bow system is drawn into in a drawn state, the outer bow grip is enabled to rotate over a limited angular range relative to the inner bow handle.

38 Claims, 15 Drawing Sheets

(56) References Cited

U.S. PATENT DOCUMENTS 5,269,284 A 12/1993 Pujos et al.
5,335,645 A 8/1994 Simonds et al.
5,349,937 A * 9/1994 Burling ..... F41B 5/10 124/25.6
5,469,834 A * 11/1995 Higgins ..... F41B 5/14 124/23.1
5,551,413 A * 9/1996 Walk ..... F41B 5/14 124/23.1
5,651,354 A * 7/1997 La Haise, Sr. ..... F41B 5/10 124/23.1
5,842,460 A * 12/1998 Barber ..... F41B 5/14 124/88
6,415,780 B1 7/2002 Proctor
6,662,798 B1 * 12/2003 Johnson ..... F41B 5/0031 124/88
6,988,495 B1 * 1/2006 Van Hoorn ..... F41B 5/14 124/88
7,066,165 B2 * 6/2006 Perry ..... F41B 5/0005 124/23.1
7,708,004 B2 * 5/2010 Moss ..... F41B 5/14 124/88
D639,888 S 6/2011 McPherson
7,954,175 B2 * 6/2011 Platt ..... A41D 13/088 124/23.1
8,783,239 B2 * 7/2014 Vyprachticky ..... F41B 5/1403 124/88
9,140,514 B2 * 9/2015 Ady ..... F41B 5/1403
2002/0073983 A1 * 6/2002 Etheridge ..... F41B 5/14 124/88
2007/0084451 A1 * 4/2007 Perry ..... F41B 5/14 124/23.1
2007/0193571 A1 * 8/2007 Moss ..... F41B 5/14 124/88
2011/0023856 A1 * 2/2011 Light ..... F41B 5/1426 124/23.1
2011/0277738 A1 11/2011 Morris, II
2013/0340735 A1 * 12/2013 Emory ..... F41B 5/1403 124/23.1
2014/0174417 A1 * 6/2014 Vyprachticky ..... F41B 5/14 124/23.1
2014/0360478 A1 * 12/2014 Ady ..... F41B 5/1403 124/23.1
2015/0211824 A1 * 7/2015 Vyprachticky ..... F41B 5/1403 124/23.1

* cited by examiner

ARCHERY TORQUE REDUCTION GRIP APPARATUS, SYSTEM AND METHOD

CROSS-REFERENCE TO RELATED APPLICATIONS

This application claims domestic priority benefit from pending provisional application U.S. 61/915,697 filed Dec. 13, 2013.

BACKGROUND OF THE INVENTION

Although the practice of archery dates back thousands of years, it was not until fairly recently that we have witnessed substantial improvements in the primary tool used to propel the arrow, namely, the bow. Yet, throughout the evolution of the bow, one feature has remained constant: the bow is still held by a human hand. Because of this simple fact, there is always the potential for the human hand to introduce unwanted torque to the bow, by way of the grip/handle, and thus reduce the accuracy with which the arrow is propelled toward its target. It is desirable to be able to control and minimize this unwanted torque to the greatest degree possible.

If a torqueing hand pressure is applied during the rearward drawing motion, upon releasing the bowstring the handle/riser element of the bow will immediately twist in the direction of this torque. This in turn will cause the arrow which is still in contact with the arrow rest and the drawstring to be propelled in a direction other than the sighted direction, rendering the shot inaccurate.

There is no denying that bow manufacturers, by means of superior technologies and materials, have made great strides in combatting bow torque. One of the most notable changes has been simply slimming down and reducing in size, the bow grip/handle itself. The rationale for this is that by reducing the surface area over which the human hand contacts the grip, one simultaneously reduces the potential for bow torque. It is also widely accepted by most archers that a loose, relaxed hand grip is desirable for reducing or eliminating bow torque.

But not all archers agree with one or both of the strategies of employing a reduced-contact handle or a looser grip. Not so long ago, the trend in bow grips was to offer a more sculpted grip designed to fit the user's hand "like a glove," enabling the archer to quickly obtain a consistent hand placement which is a key to accuracy regardless of the grip style used.

While there can be little doubt that with practice, discipline, and proper equipment, an archer can successfully execute an accurate shot with a bow, the fact remains that bow toque continues to this day to be a substantial problem for archers. This is evidenced by witnessing a target archer meticulously and methodically place their open hand on the bow grip to search for the "sweet spot" before each shot. Target shooters are well aware that even if a loose, relaxed grip is employed, the lower, fleshy portion of the palm can by itself introduce torqueing, causing a rebounding effect after the string is released. This torqueing, no matter how minimal, can be devastating to accuracy, especially for longer distance shots which greatly magnify the applied torque.

It is therefore very desirable to provide a torque-reducing grip that can be used in modern compound and recurve bows. Compound bows are bows which incorporate one or more wheels, cams and cables, while recurve bows employ a string-only system, often with a non-wood riser.

In particular, it is highly desirable, when the bow system is drawn into in a drawn state, to enable the outer bow grip to rotate over a limited angular range relative to the inner bow handle so as to minimize torqueing.

It is also very desirable, when the bow system is in an undrawn state, to ensure that outer bow grip is prevented from rotating relative to the inner bow handle.

SUMMARY OF THE INVENTION

Disclosed herein is an archery bow system apparatus and related methods for reducing bow torque, comprising: an outer bow grip; and an inner bow handle enclosed by the outer bow grip; wherein: when the bow system is in an undrawn state, the outer bow grip is prevented from rotating relative to the inner bow handle; and when the bow system is drawn into in a drawn state, the outer bow grip is enabled to rotate over a limited angular range relative to the inner bow handle.

BRIEF DESCRIPTION OF THE DRAWINGS

The features of the invention believed to be novel are set forth in the appended claims. The invention, however, together with further objects and advantages thereof, may best be understood by reference to the following description taken in conjunction with the accompanying drawing(s) summarized below.

FIGS. 5 and 6 together thereby illustrate this first preferred embodiment respectively, in the non-drawn and drawn positions.

FIGS. 5 and 6 together thereby illustrate this second preferred embodiment respectively, in the non-drawn and drawn positions.

DETAILED DESCRIPTION

Figure 4:
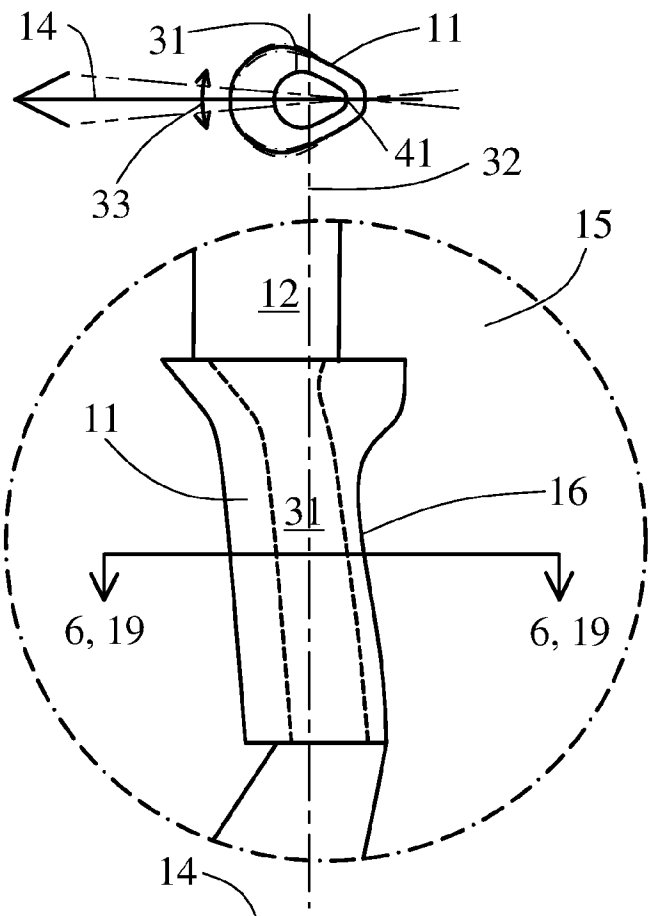
FIG. 4 is a magnified side plan view of FIG. 2 detailing the relative relationship between the outer bow grip and the inner bow handle when the bow system is in the drawn position of FIG. 2, together with a projection showing a top cross-sectional schematic view of this relationship.
Figure 5:
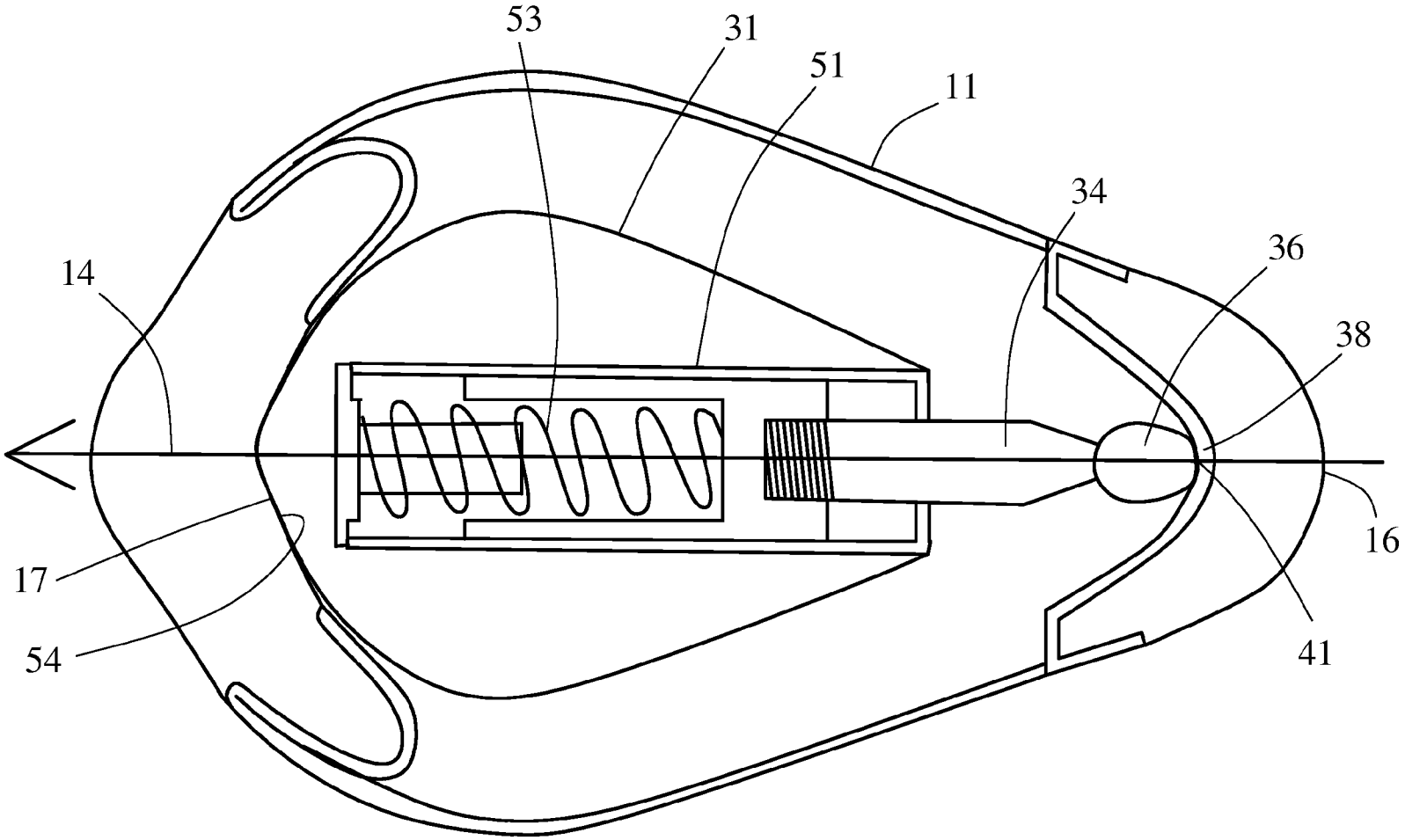
FIG. 5 is a top-down cross sectional view taken over the plane designated as 5-5 in FIG. 3, and is a first preferred embodiment for the inventive principle schematically illustrated by the projection at the top of FIG. 3 when the bow system is in the non-drawn position of FIG. 1.
Figure 6:
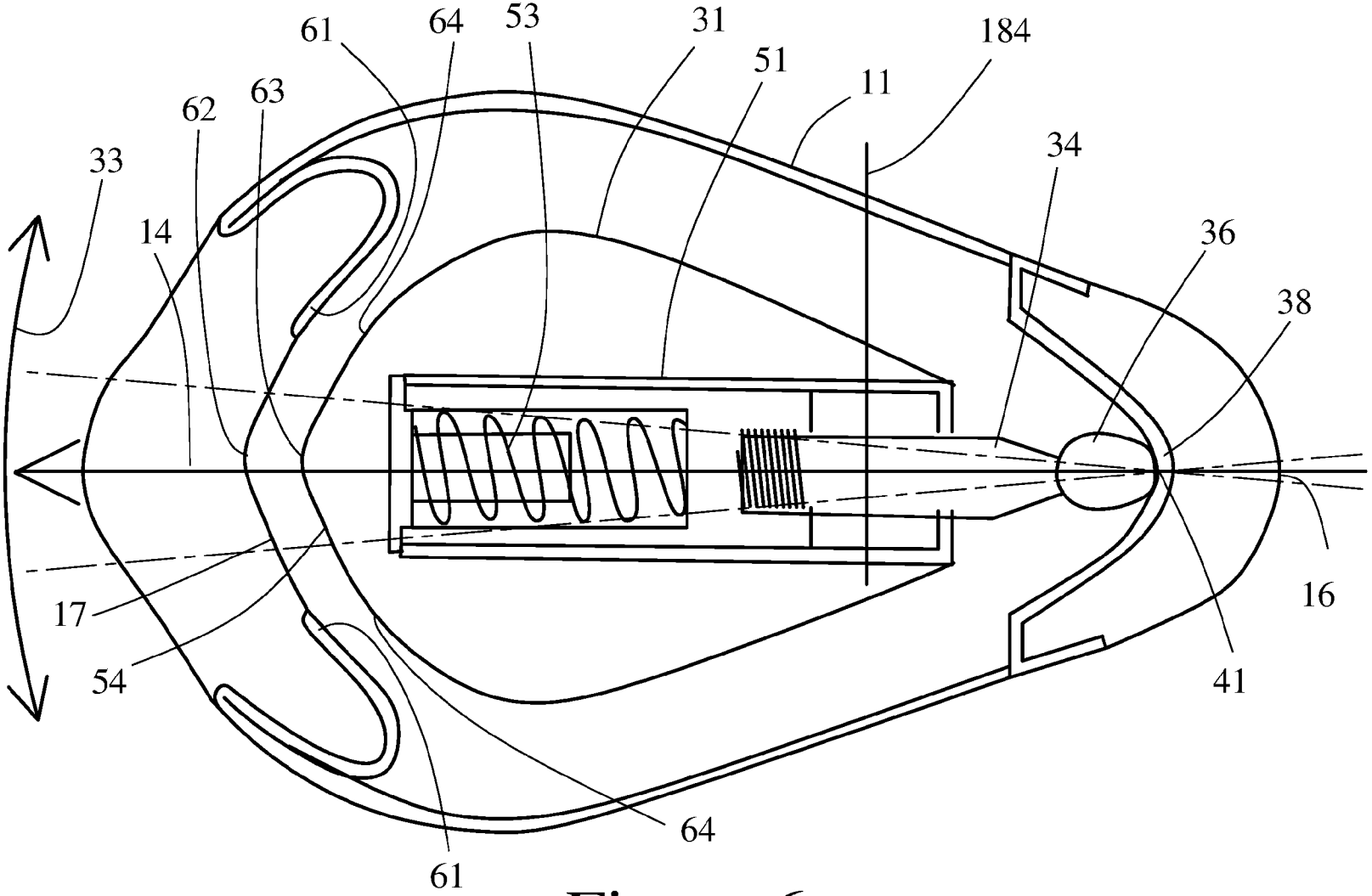
FIG. 6 is a top-down cross sectional view taken over the plane designated as 6-6 in FIG. 4, and is the first preferred embodiment for the inventive principle schematically illustrated by the projection at the top of FIG. 4 when the bow system is in the drawn position of FIG. 2.

Referring to FIGS. 1 through 6, the objective of reducing bow torque is achieved by attaching an independent outer bow grip 11 to the main handle/riser element 31 of the bow 12 which outer bow grip 11 is slightly larger than, yet largely minors and mates with in a manner to be disclosed in detail here, the cross-sectional profile/shape of an inner bow handle 31. In particular, from a cross-sectional view, this mating provides a continuous air space between the outer bow grip 11 and the inner bow handle 31, with the exception of two carefully designed connection/contact points. As seen in FIGS. 5 and 6, these two connection points comprise, for example not limitation, a spherical or concave tipped shaft or pin 34 which protrudes out from the archer's side of the inner bow handle 31 and connects to the inside of the outer bow grip 11 by seating or snapping into a slightly-larger conformed socket or pin aperture 35 (FIG. 10) of corresponding shape, providing for relatively frictionless pivoting to occur between the outer bow grip 11 and the inner bow handle 31. Further, and very centrally, this pivoting is enabled to occur only when the bow is in a drawn position but not when it is in a non-drawn position. In other words, the outer bow grip 11 and inner bow handle 31 are relatively configured so as to enable a smooth, substantially frictionless pivoting between the outer bow grip 11 and inner bow handle 31 when the bow system 1 is drawn backward ready to fire, but to prevent any relative pivoting whatsoever when the bow system 1 is released into a non-drawn position. In the non-drawn (post or pre-drawn) position, the outer bow grip 11 and inner bow handle 31 appear to be one and the same with no relative pivoting motion between them, while in the drawn position, a smooth, substantially frictionless pivot is enabled to occur.

The aforementioned tipped shaft or pin 34, in one of several preferred alternative embodiments, is part of a self-contained spring cartridge 51 which is inserted into the inner bow handle 31. This is preferably built into the bow 12 and particularly the bow handle 31 as part of the bow manufacturing process. While this disclosure illustrates and will be developed with a spring cartridge 51, it is to be understood that this is exemplary, not limiting. One may employ a simple spring with or without a spring cartridge. Or, one may employ a spring or any equivalent apparatus which exerts an outward force when pressed inward from an expanded position thereof and returns to said expanded position when said inward pressing is relieved. Two such variations are illustrated in FIGS. 14 through 17. Additionally, for example, not limitation, one can alternatively use a pair of magnets in a channel, with like-poles oriented such that the magnets repel to effectuate the outward force exertion of a spring.

It is upon drawing the bowstring 13 backwards that the torque-free characteristics of applicant's invention are actuated. When the bowstring 13 draws backwards, the user's hand will inherently press the outer bow grip 11 forward relative to the inner bow handle 31, reconfiguring the relative relationship between the two. The reconfiguration is designed to enable a free-floating pivot 33 between the outer bow grip 11 and the inner bow handle 31, about a fulcrum 41. The "feel" of this free pivot is telegraphed to the archer's hand, ensuring that no torque is being applied (and more precisely, ensuring that any rotation applied to the outer bow grip 11 does not translate into any torque on the inner bow handle 31), while still channeling hand pressure to the exact center of the inner bow handle 31 via the reconfiguration of outer bow grip 11 and inner bow handle 31 relationship. After the bowstring 13 is released, due to the decompression of the compressible spring cartridge 51, the outer bow grip 11 will return to the pre-draw stationary position and there will no longer be any relative rotation permitted between the outer bow grip 11 and the inner bow handle 31.

Now, let us review the apparatus and method of this invention in detail.

Figure 1:
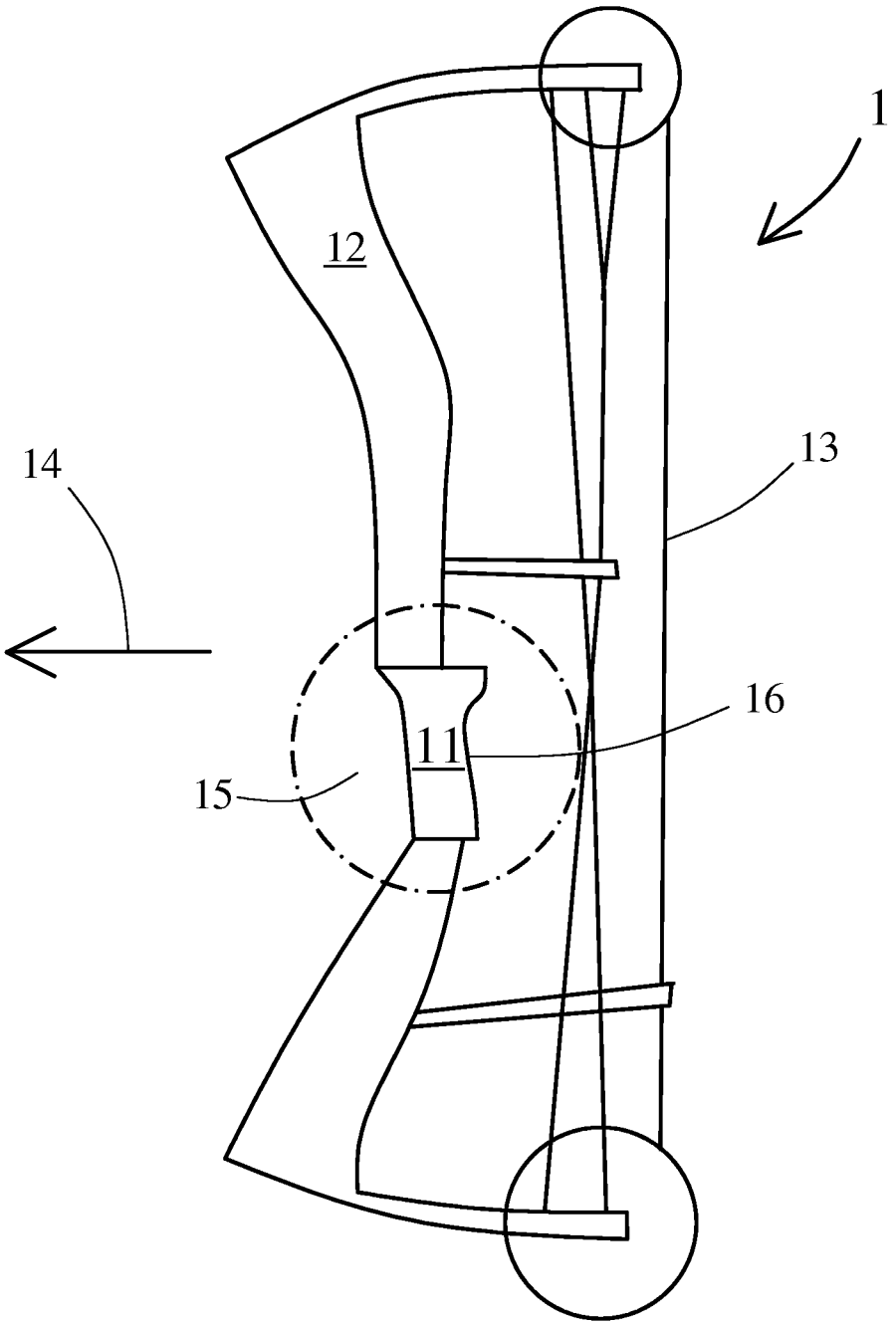
FIG. 1 illustrates a side plan view of a bow system which includes applicant's invention, in a non-drawn position.

FIG. 1 illustrates a plan view of a bow system 1 which includes applicant's invention, in a non-drawn position. Specifically, FIG. 1 illustrates an outer bow grip 11 forming part of the bow 12. Toward the right side of this figure one sees a bowstring 13 which as will easily be recognized, is in a non-drawn position. Although the bow system 1 in this illustration is a compound bow system, this is merely an exemplary bow system, and is in no way limiting as regards the applicability of the disclosed invention. This invention may be used as part of any and all bow systems, whether they are compound bow systems, recurve bow systems, or any other type of bow system. It will also be recognized that when this bow system is used to shoot at a target, the flight direction of the arrow (not shown) will be from right to left, along the direction-of-flight arrow 14. This direction-of-flight arrow 14 will be used throughout all of the other figures as a visual aid to establish a consistent directional orientation so the reader of this disclosure may better understand the nature and operation of this invention. Also identified is a forward hand-pressure region 16 which, as will be appreciated by anybody of ordinary skill, is where the archer's forward hand will exert forward pressure on outer bow grip 11 when the bowstring 13 is drawn backwards.

The invention is based upon the manner in which the outer bow grip 11 works in relation to an inner bow handle 31 which is enclosed therein and therefore visually hidden by thereby. The encircled area 15 containing outer bow grip 11 will be magnified and shown in more detail in FIGS. 3 and 4, and will depict inner bow handle 31 using a hidden line illustration.

Figure 2:
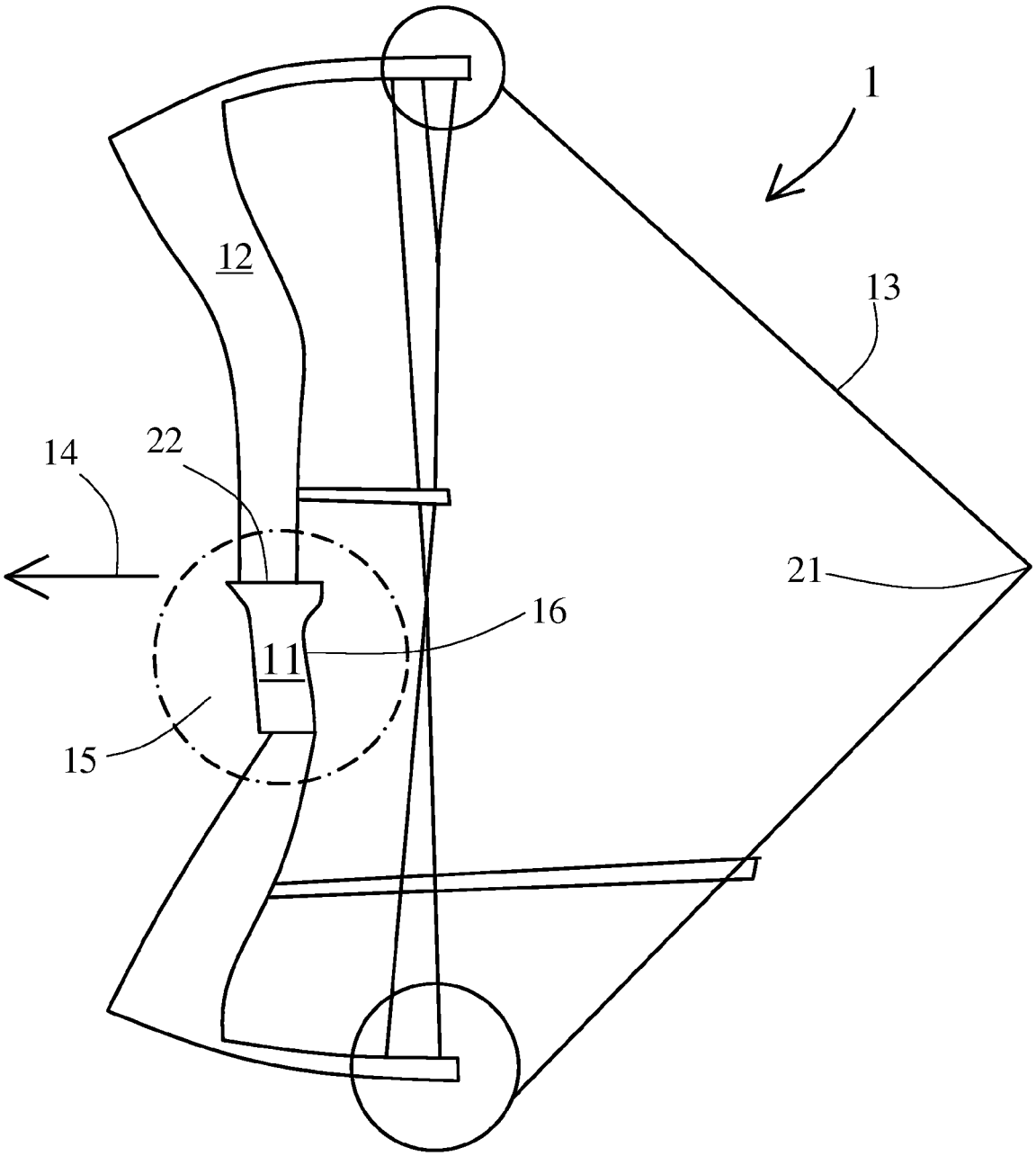
FIG. 2 illustrates a side plan view of the bow system of FIG. 1, in a drawn position.

FIG. 2 illustrates a plan view of the bow system 1 of FIG. 1, now in a drawn position. This is plainly evident by the fact that bowstring 13 is pulled backwards to form a sideways "v" at a rear arrow location 21 where the rear of an arrow (not shown) would contact the bowstring 13 when the latter is pulled back into the drawn position. The forward portions of the arrow would in turn rest upon an arrow rest 22, as should also be plainly evident.

It will be appreciated by those of ordinary skill that when the bow system is in the drawn position of FIG. 2, for a right-handed archer the archer's right hand will be pulling backwards at rear arrow location 21 with a certain amount of force, while the archer's left hand will be pressing forward against the rear of outer bow grip 11 proximate forward hand-pressure region 16 with an equal and opposite amount of force. For a left-handed archer the aforementioned is reversed. Thus, to be perfectly general, we shall simply henceforth refer to the archer's "forward hand" and "rear hand."

It is particularly important to note that when the bow system 1 is in such a drawn position, the archer's forward hand will apply a forward pressure against outer bow grip 11 at forward hand-pressure region 16, which pressure during the backwards draw of bowstring 13 will be equal in magnitude and opposite in vector direction to the strength of the bow system 1 at various points of draw. For example, if the particular bow system has a forty (40) pound draw when fully drawn, then the archer's forward hand will inherently apply forty (40) pounds of forward pressure against outer bow grip 11 at forward hand-pressure region 16. (The use of pounds as a weight measure is exemplary and in no way limiting as to like-measurements in kilograms.) Many modern bow systems are actually designed to vary the pressure during the draw to actually reduce the pressure at the very back of the draw. This pressure "let-off" enables the archer to maintain the bow system 1 in a drawn position for a prolonged period of time without tiring while waiting for just the right moment to release the arrow toward the target. Irrespective of the strength of a particular bow system 1 or any variations in strength at various positions of draw, the forward pressure at forward hand-pressure region 16 will, at any point along the draw, be equal and opposite to the bow system strength at the same point in the draw. So as soon as there is any resistance/strength introduced during the draw, a forward pressure equal to that resistance/strength will be applied at forward hand-pressure region 16.

This is important, because it is central to how the invention is actuated and deactuated. Specifically, contrasting FIGS. 1 and 2, in the non-drawn configuration of FIG. 1, there will be no forward pressure at all against forward hand-pressure region 16, while in the drawn configuration of FIG. 2 as well as during the draw back into the FIG. 2 configuration, there will be a definitive pressure against forward hand-pressure region 16 which is measured by the strength of the bow system 1 at any given point during the draw. This forward hand-pressure, which is an inherent feature of bow and arrow systems, is therefor used to press the outer bow grip 11 slightly forward relative to the rest of bow 12 when the bowstring 13 is drawn back, and it is this relative movement induced by the forward pressure of the archer's forward hand against forward hand-pressure region 16 which is central to actuating applicant's invention. Thus, if one closely contrasts the encircled 15 position of outer bow grip 11 relative to the rest of bow 12, it will be seen that in FIG. 2, the outer bow grip 11 is pressed somewhat forward relative to its illustrated position in FIG. 1.

Having described the actuation of the invention, we may now explain its principle of operation, which is simply this: When the bow system is in a non-drawn configuration of FIG. 1, the outer bow grip 11 situates in a first position relative to the rest of bow 12, which is illustrated in FIG. 1, and detailed in the magnified view 15 of FIG. 3. When the bow system is in a drawn configuration of FIG. 2, the outer bow grip 11 situates in a second position relative to the rest of bow 12, which is illustrated in FIG. 2, and which is slightly forward in relation to the position illustrated in FIG. 1, as detailed in the magnified view 15 of FIG. 4. In the first position of FIG. 1, the outer bow grip 11 mates together relative to the rest of bow 12 so that there is no rotation permitted between outer bow grip 11 and the rest of bow 12. In the second, slightly-forward position of FIG. 2, the outer bow grip 11 un-mates from the rest of bow 12 so as to permit a limited rotational freedom between the outer bow grip 11 and the bow 12 about the long axis of the bow 12. It is this small degree of rotational freedom which serves to reduce torque and thus enhance the shooting accuracy of bow system 1.

In particular, there are two aspects of what has just been described which, in combination, serve to enhance shooting accuracy. First, when the bowstring 13 is not drawn as illustrated in FIG. 1, the outer bow grip 11 and the bow 12 are mated together with no relative rotation permitted between them, and so the bow system 1 has the precise feel of an ordinary bow system absent applicant's invention. Because there is no rotation at all between outer bow grip 11 and the bow 12, the archer can set up for shooting in the customary manner. Were there to be a rotation permitted even in the undrawn position as is the case in the prior art, see, e.g., U.S. Pat. Nos. 4,966,124; 6,988,495; 7,708,004; and 8,783,239, this would make it difficult for the archer to properly set up for shooting, because even with a firm grip on outer bow grip 11, there would be random pivotal moment of the bow 12 relative to the grip 11. The absence of rotation in the non-draw position of the present invention, overcomes this prior art deficiency.

Second, once the bowstring 13 becomes drawn as illustrated in FIG. 2, the outer bow grip 11 becomes unmated from the bow 12 and a limited relative rotation is now permitted. At this point in time, although pivotal movement is enabled between outer bow grip 11 and bow 12, the archer's front and rear hands still define between them, a directional line 14 toward the target, so any pivotal moment is no longer random but is instead a function of the archer's hand movements and relative hand positions. In the event the archer's forward hand does rotate slightly in one direction or another, the directional line 14 toward the target will remain established by the linear relation between the archer's front and rear hands, but importantly, will not be impacted by this posited rotation of the archer's front hand because that rotation will become absorbed in a rotation of the outer bow grip 11 relative to the bow 12, and the bow 12 itself will not rotate at all but will have its linear aim determined solely by the linear relation between the archer's front and rear hands.

This is to be contrasted to an ordinary bow system in which a rotation of the archer's front hand is passed immediately through to the bow 12 and creates undesired torqueing. In the bow system 1 of the present invention, a rotation of the archer's front hand does not pass through to the bow 12, but disappears in a rotation of the outer bow grip 11 relative to the bow 12. In sum, this second aspect of the invention separates the linear degree of freedom defined by the line 14 between the archer's forward and rear hands from the rotational degree of freedom defined by any rotation of the archer's forward hand. Thus, shooting accuracy is enhanced because the direction of the shot is defined only by the line 14 between the archer's forward and rear hands and not by any torque-inducing rotation of the archer's front hand. That is, accuracy is enhanced by separating the linear from the rotational components of the archer's hand movements such that the direction of shooting is determined only by the relative linear relationship between the archer's two hands and not by any front-hand rotational components.

The novel and inventive combination of these two aspects of the invention just described forms the basis for an apparatus, system and method in which when the bow system is in an undrawn position, the outer bow grip 11 and the bow 12 are mated together such that there is no relative rotation permitted between them, while when the bowstring 13 is drawn so as to introduce a forward hand-pressure region against the outer bow grip 11, the outer bow grip 11 and the bow 12 become unmated such that a limited relative rotation becomes permitted between them. The former undrawn configuration enables the archer to set up for a shot by gripping the outer bow grip 11 while it is firmly mated with the bow 12 thus permitting no random rotational movements therebetween. Then, simultaneously with the natural, inherent course of the draw, outer bow grip 11 becomes unmated from the bow 12 such that a rotational movement therebetween becomes permitted, wherein any rotation of the archer's front hand is absorbed into a rotation of the outer bow grip 11 about bow 12 without affecting the directional line 14 toward the target as between the archer's front and rear hands. In combination, all of this reduces or eliminates torqueing and thus improves shooting accuracy.

Figure 3:
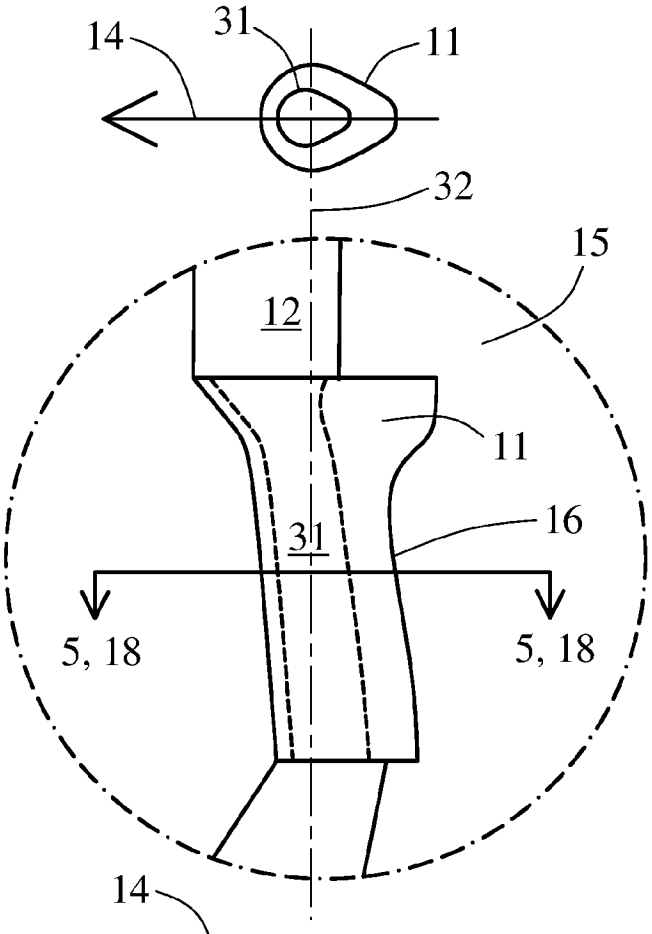
FIG. 3 is a magnified side plan view of FIG. 1 detailing the relative relationship between an outer bow grip and an inner bow handle when the bow system is in the non-drawn position of FIG. 1, together with a projection showing a top cross-sectional schematic view of this relationship.

As described above, and as will now be further detailed, this invention is based upon the manner in which the outer bow grip 11 works in relation to the inner bow handle 31 which is enclosed therein. The inner bow handle 31 may also be referred to at times as the bow riser. FIGS. 3 and 4 are magnified views of the encircled area 15 from FIGS. 1 and 2, detailing the relative relationship between outer bow grip 11 and inner bow handle 31 in, respectively, the non-drawn position of FIG. 1 and the drawn position of FIG. 2. In these FIGS. 3 and 4, inner bow handle 31 is illustrated by hidden lines because it is enclosed by and so is visually hidden within outer bow grip 11. As will be seen from FIGS. 3 and 4, inner bow handle 31 is integrally and unitarily fabricated with the bow 12, connecting an upper portion of the bow 12 above outer bow grip 11 with a lower portion of the bow 12 below outer bow grip 11. The sole difference between FIGS. 3 and 4 is that in FIG. 3, the bow system 1 is not drawn, so there is no forward pressure on outer bow grip 11 at forward hand-pressure region 16. Consequently, outer bow grip 11 is in a rearward position relative to bow 12 and inner bow handle 31 which position does not allow for any rotational/pivotal motion of outer bow grip 11 relative to bow 12 and inner bow handle 31 about the long vertical axis 32 of bow 12.

In contrast, in FIG. 4 the bow system 1 has been drawn, so as discussed in connection with FIG. 2 there is a forward pressure on outer bow grip 11 at forward hand-pressure region 16. As a consequence of this forward pressure, outer bow grip 11 has been pressed into a forward position relative to bow 12 and inner bow handle 31, and this position now does allow a limited rotation/pivot motion of outer bow grip 11 relative to bow 12 and inner bow handle 31 about the long axis 32 of bow 12. It is to be noted that FIGS. 3 and 4 are not drawn to precise scale, but rather are drawn to emphasize the relative forward and back movement as between outer bow grip 11 and inner bow handle 31 depending upon the draw state of the bow system 1.

Specifically, the rearward non-rotating position of FIG. 1 for which the operative portion is magnified in FIG. 3 connects/seats the outer bow grip 11 with the bow 12 and inner bow handle 31 so as to prevent (immobilize) any rotation therebetween; while the forward limited-rotation position of FIG. 2 for which the operative portion is magnified in FIG. 4 disconnects/unseats the outer bow grip 11 from the bow 12 so as to permit limited rotation therebetween. This is illustrated by the schematic projections at the top of FIGS. 3 and 4 showing a top cross-sectional schematic view of the relationship between outer bow grip 11 and inner bow handle 31. Specifically, in FIG. 3, one will take note of the projection line coincident with the long axis 32 of bow 12 which leads to a top-cross sectional view at the top of FIG. 3 which will be further detailed in the preferred embodiment of FIG. 5. In FIG. 3, we see how outer bow grip 11 encloses inner bow handle 31 such that, in juxtaposition to FIG. 4, there is no rotation permitted between these two elements. So if outer bow grip 11 is aligned with the direction-of-flight toward the target as indicted by arrow 14, the inner bow handle 31 will be commensurately aligned. In contrast, in FIG. 4, we schematically see how outer bow grip 11 has been pressed forward relative to and simultaneously become disconnected/unseated from inner bow handle 31 so that a relative rotation 33 is now enabled between these two elements about a fulcrum 41, which will be further detailed in the preferred embodiment of FIG. 6.

To understand the main inventive principle of the invention, one will now observe that in the top projections of FIG. 4, the inner bow handle 31 and thus the bow 12 integral therewith is still shown to be fixed, i.e., not rotating. But now, the outer bow grip 11 is schematically shown to have a limited flexibility to rotate about the inner bow handle 31, as designated by the rotational arc 33 about a rotational fulcrum 41. This is a central point, because this is how any rotation from the archer's front hand is prevented from introducing torqueing. It is the relative relationship between the archer's front and rear hands which defines the direction-of-flight line 14 and that thus fixes the orientation of inner bow handle 31, based on this relative hand alignment, toward the desired direction of flight 14. Thus, if the archer's front hand should happen to rotate, all of that rotation becomes absorbed in the rotation of outer bow grip 11 along rotational arc 33 about fulcrum 41, and is not telegraphed as a toque over to the inner bow handle 31 and thus to the bow 12. Rather, it is desirable that the bow 12 remains in a fixed orientation along direction-of-flight line 14.

It is the combination of FIGS. 3 and 4, wherein relative rotation of outer bow grip 11 about inner bow handle 31 and bow 12 is prevented in the undrawn state of FIG. 3 but enabled (within a predetermined limited range) in the drawn state of FIG. 4 which provides the novel and non-obvious functionality whereby the archer can set up to shoot with the bow system 1 in a state wherein the outer bow grip 11 and the bow 12 coact as one, while once the archer has drawn the bowstring 13, the outer bow grip 11 is enabled to separate from and rotate within limited range about bow 12 in order to absorb any rotation from the archer's front hand and thus prevent torqueing.

While the limited range of rotation designated by angle 33 in this illustration of FIG. 4 is shown to be five (5) degrees from the direction-of-flight line 14, this is illustrative and non-limiting. It is envisioned that the invention may be embodied such that this predetermined limited range of rotation designated by angle 33 can be as large as forty five (45) degrees, or alternatively, as large as forty (40), thirty five (35), thirty (30), twenty five (25), twenty (20), fifteen (15), twelve (12), ten (10), eight (8), six (6), four (4) or three (3) degrees. In practice, it is desirable to maximize this permitted range of rotation 33 about fulcrum 41, by making the inner bow handle 31 as thin as possible consistent with ensuring that the bow 12 and inner bow handle 31 maintain structural integrity in view of the pressures they must sustain when the bow system 1 is repetitively drawn and released for shooting, and by making the outer bow grip 11 as wide as possible consistent with a controlled, ergonomically-desirable grip surface for the archer's forward hand. It is to achieve this balance that the illustrated "teardrop" is a preferred albeit non-limiting shape for the cross sections illustrated in the top projections of FIGS. 3 and 4, and in FIGS. 5 to 9 and 12 and 13 to follow. This is because the larger width toward the front of the teardrop gives maximum play for rotation consistent with structural integrity while the narrower width toward the rear of the teardrop provides a slim profile for a proper ergonomic grip and a firm rotational seating at the fulcrum 41.

The foregoing describes the principles of operation of the invention. The balance of this disclosure describes a variety of preferred embodiments of the invention designed to reduce these inventive principles of operation to practice in any and all bow systems. While several embodiments will be described, it is to be understood that these embodiments are exemplary and non-limiting, and that any other embodiments that may be developed by a person of ordinary skill in the art which accord with this principle of operation, even if differing in detail from the embodiments disclosed here, are still regarded to be within the scope of this disclosure and its associated claims. Particularly, once the principle of the invention schematically illustrated by the cross-sectional projections of FIGS. 3 and 4 is understood, and once a preferred embodiment has been disclosed for achieving this principle, it will become apparent to persons of ordinary skill how to implement this invention in a variety of specific alternative embodiments, all of which are to be regarded as falling within the scope of this disclosure and its associated claims.

We now turn to a first preferred embodiment, which is illustrated in FIGS. 5 through 9. Although as just observed, the preferred cross-sectional shape of this embodiment is that of a "teardrop" which yields a proper ergonomic hand position on the exterior of outer bow grip 11 and maximizes the permitted range of rotation 33 about fulcrum 41 consistent with structural integrity, this cross-sectional shape is illustrative, not limiting. Other shapes which might be equally suited to proper hand placement, or which may be preferred based on varying individual archer preferences, are also to be regarded within the scope of this disclosure and its associated claims.

FIG. 5 is a top-down cross sectional view taken over the plane designated as 5-5 in FIG. 3, and is a first preferred embodiment for the inventive principle schematically illustrated by the projection at the top of FIG. 3 showing the bow system 1 in the non-drawn position of FIG. 1. FIG. 6 is a top-down cross sectional view taken over the plane designated as 6-6 in FIG. 4, and is a first preferred embodiment for the inventive principle schematically illustrated by the projection at the top of FIG. 4 showing the bow system 1 in the drawn position of FIG. 2. FIGS. 5 and 6 together thereby illustrate this first preferred embodiment respectively, in the non-drawn and drawn positions.

Figure 11:
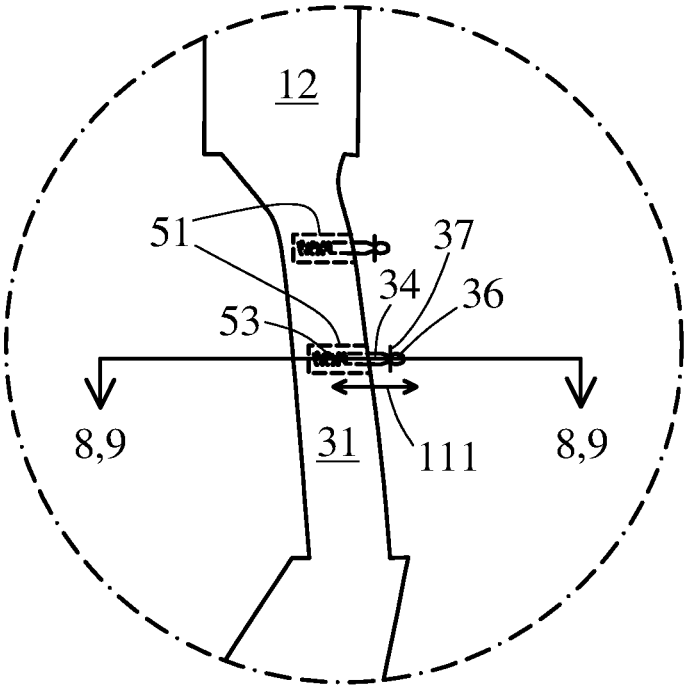
FIG. 11 further details the views of FIGS. 3 and 4 in the embodiments of FIGS. 8 and 9, and in particular, to show the placement of one or more (preferably two) spring cartridges within the inner bow handle as well as the movement of a pin and pin head in and out of the spring cartridge in accordance with the draw state of the bow system.

In FIG. 5, we see that a front riser surface 54 of inner bow handle 31 is configured so as to mate with an inner front bumper 17 of outer bow grip 11, and, in FIG. 5, that the front riser surface 54 and the inner front bumper 17 are in fact mated in contact with one another. Taken in combination with a pin 34 with an optional rear-tapering as illustrated (this does not exclude using a non-tapered pin) which terminates in a (rounded) pin head 36, it will be seen that the two horizontally-situated positions of contact at 17, 54 (front) and at a fulcrum 41 of a rear pin pressure socket 38 (rear) serve to restrain any rotation of outer bow grip 11 about inner bow handle 31 and thus about the bow 12 with which inner bow handle 31 is integral and unitary, see FIG. 3, so that both remain co-aligned along direction-of-flight arrow 14. Preferably, as illustrated in FIG. 11, this contact arrangement is replicated along two vertically-displaced horizontal cross sections. In the variation shown in FIG. 12, we also see a pin aperture 35, a flexible aperture element 37 and a rear pin pressure socket 38 which are used to apply some of the pressures which cause the invention to properly operate when the bow system 1 is drawn. This will be further described in connection with FIGS. 7 through 9, which show outer bow grip 11 and inner bow handle 31 as separate components.

Figure 13:
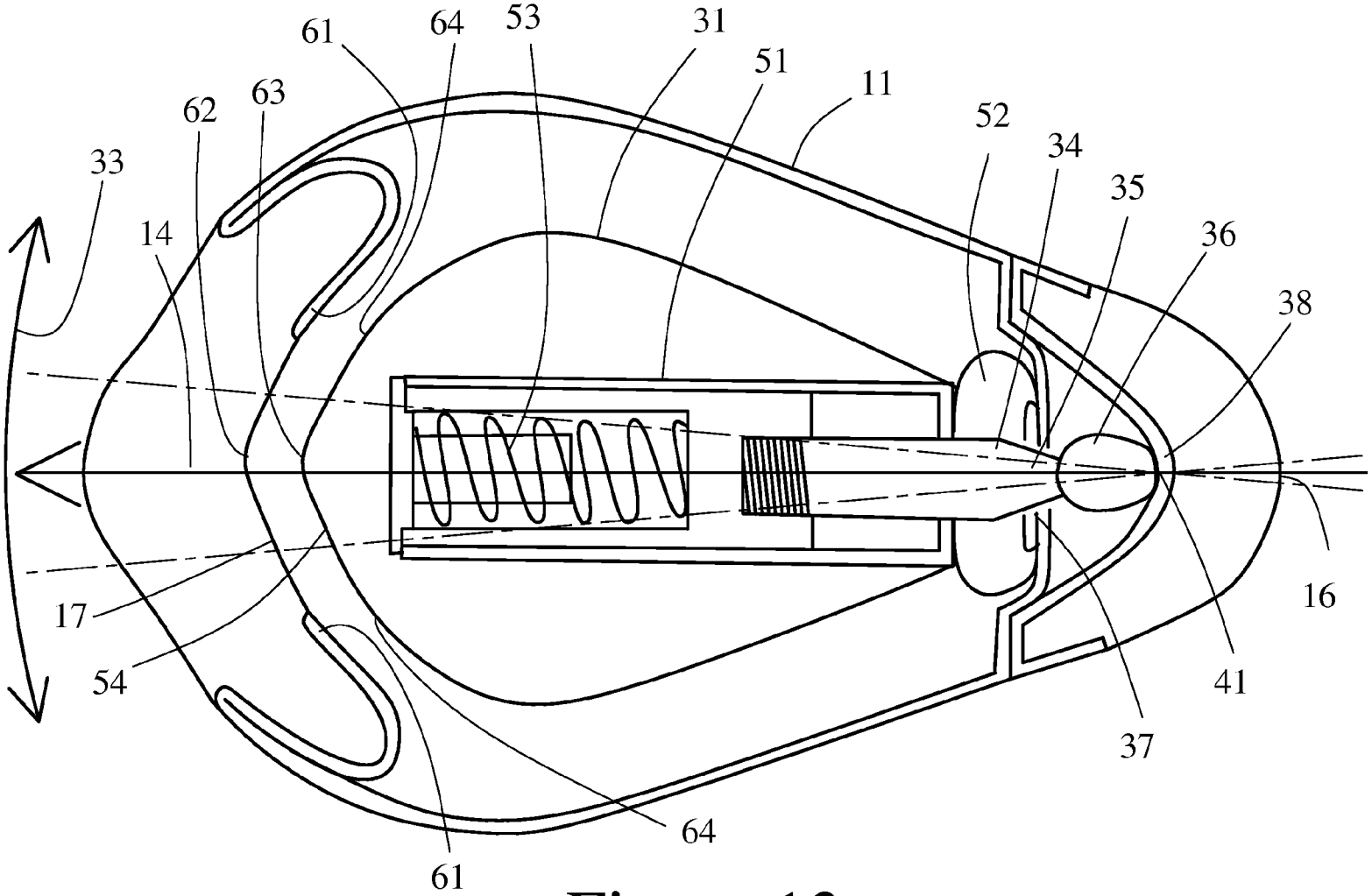
FIG. 13 is a variation on the drawn position illustration of FIG. 6, which includes the optional flexible aperture element and optional rotation damper.

In FIG. 6, in contrast, we see that the forward hand pressure applied at forward hand-pressure region 16 from the draw of the bow string 13, see FIG. 2, has caused outer bow grip 11 to move forward relative to inner bow handle 31, and that consequently, the front riser surface 54 has retreated from the inner front bumper 17 so that these are no longer in contact with one another and the front point of contact is now released. Simultaneously, however, the horizontally-related rear point of contact remains between pin head 36 and rear pin pressure socket 38 at fulcrum 41. The concave shape of rear pin pressure socket 38 ensures that the fulcrum 41 will remain substantially centered toward the rearmost extremity of rear pin pressure socket 38. As illustrated in the variations of FIG. 13, a seating of pin 34 within an optional pin aperture 35 is configured—in combination with further elements to be discussed below—to enable rotation smooth about fulcrum 41 through rotational arc 33, and thus allow any rotation by the archer's front hand to be absorbed in a rotation of outer bow grip 11 without causing any torqueing of inner bow handle 31.

Thus, with the rear point of contact maintained at fulcrum 41 but the front point of contact between 17 and 54 relieved, it will be appreciated by someone of ordinary skill that in FIG. 6, outer bow grip 11 may now rotate over a limited range relative to inner bow handle 31 about fulcrum 41 through the rotational arc 33 shown toward the left of FIG. 6. It will further be appreciated how this is but one of a number of possible embodiments which can be used to reduce to practice, the inventive principles disclosed in connection with FIGS. 3 and 4. Finally, it will be appreciated how once the inventive principle outlined in FIGS. 3 and 4 and the implementing embodiment of FIGS. 5 and 6 are understood by a person of ordinary skill, that other possible embodiments to implement the inventive principle of FIGS. 3 and 4 will also become apparent to a person of ordinary skill within the scope of this disclosure and its associated claims. Now let us elaborate several other aspects of the embodiment shown in FIGS. 5 and 6, which deal with the spring mechanism used to provide the required pressures and rotations to operate the invention as just described.

Figure 12:
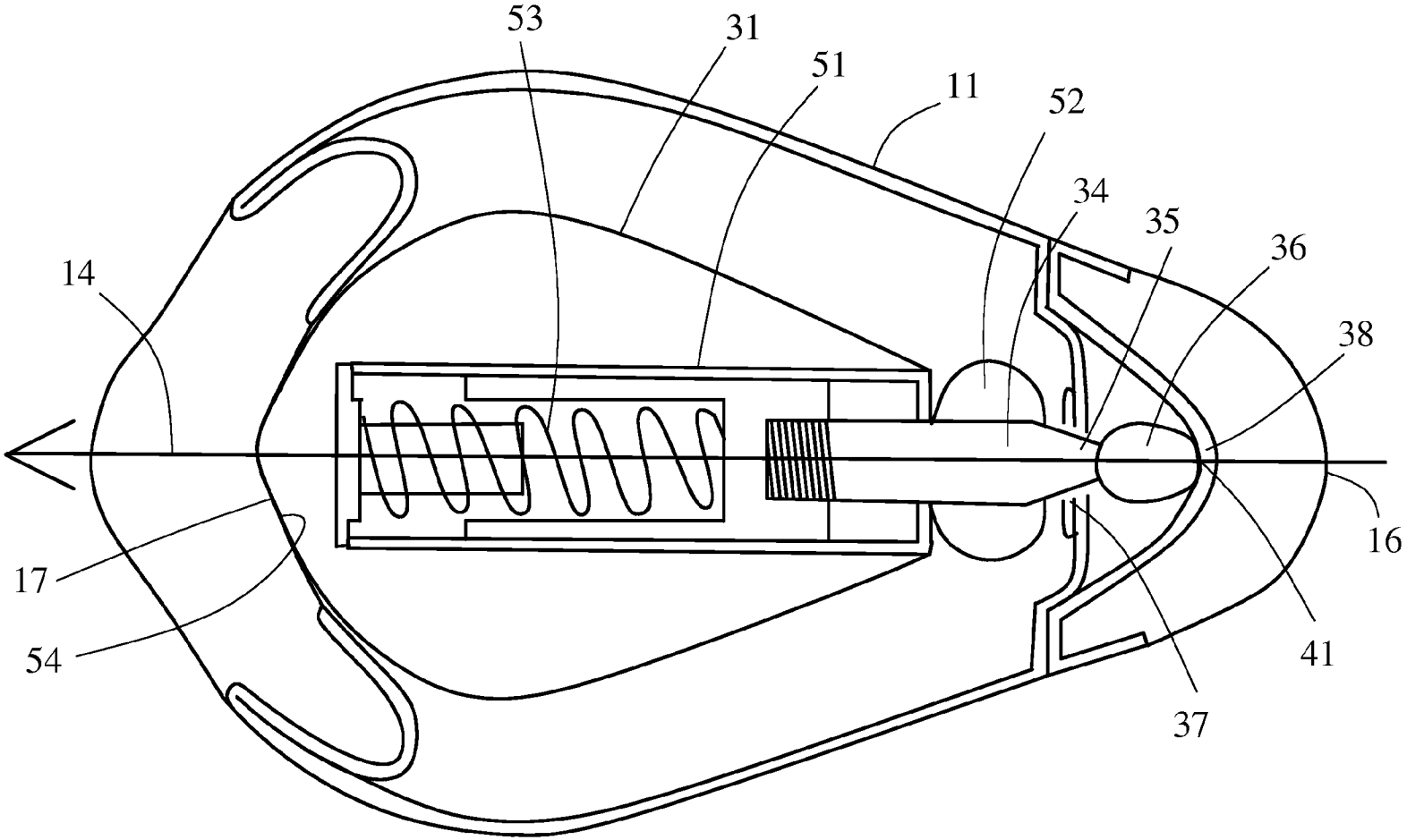
FIG. 12 is a variation on the non-drawn position illustration of FIG. 5, which includes an optional flexible aperture element and an optional rotation damper.

First, in FIGS. 5 and 6, we see a spring cartridge 51 which is used to manage the retreat of the front riser surface 54 from the inner front bumper 17. This spring cartridge 51 also cooperates with an optional flexible compressible doughnut-shaped rotation damper 52 introduced in FIG. 12. In FIG. 12, rotation damper 52 is uncompressed and in FIG. 13 it is compressed. When a drawn bow system 1 is released, rotation damper 52 springs back from its compressed to its uncompressed state, as does the spring cartridge 51. The purpose of rotation damper 52—which again is optional not required—is to help smooth/damp/desensitize the pivoting of outer bow grip 11 relative to inner bow handle 31 about fulcrum 41.

It will be appreciated on physical grounds that the spring cartridge 51 system must have a strength that is less than the strength of the bow system 1 when in a fully-drawn position, to enable pressure at forward hand-pressure region 16 from the drawn bowstring 13 to compress the spring 53 so as to enable the retreat of the front riser surface 54 from the inner front bumper 17. It will be appreciated that the exemplary spring 53 is an ordinary linear spring which is extended when no inward longitudinal force is applied, and is contracted but will apply outward pressure when an inward longitudinal force is applied.

Now let us posit, for example, not limitation, that the invention is used with a compound bow system 1 which requires 80 pounds of pressure to draw the bowstring 13 back, and that bow system 1 has an 80% letoff. Thus, as the bowstring 13 reaches its maximal rearward extension, to bow system 1 causes the pressure to drop by 80% times 80 pounds=64 pounds, down to 80 minus 64=16 pounds. Thus, the archer can use only 16 pounds of hand pressure to maintain the bow system 1 in a shooting position for a period of time without tiring until he or she has a good sight line to the target. This means that the spring cartridge 51 must have a compression pressure of less than 16 pounds, so that the application of 16 pounds of pressure or more causes the spring to compress and maintain itself in that compressed state.

As a shorthand way to discuss this, we may say that the spring cartridge compression strength must be less than the bow system strength at maximal rearward extension ("maximal extension strength"). It will also be appreciated that the spring cartridge compression strength should not be too much less than the maximal extension strength, so that front riser surface 54 will remain in contact with inner front bumper 17 in the FIG. 5 configuration until a substantial amount of draw pressure is applied, and there is no at risk of disconnecting this contact with just a minimal applied pressure. Certainly, this spring cartridge compression strength should be closer to the maximal extension strength than to zero. Consequently, we may discuss this by stating that spring cartridge compression strength should be at least to 50% of the maximal extension strength. In the preferred embodiment, putting all of this together, this means that the spring cartridge compression strength should be greater than or equal to a lower bound of 90% of the maximal extension strength and less than an upper bound of the maximal extension strength. In alternative variations, this lower bound may be 85%, 80%, 75%, 70%, 65%, 60%, 55% and as already noted, no lower than 50%. In the non-limiting example just presented, an 80 pound bow system with an 80% letoff has a maximal extension strength of 16 pounds. So the spring cartridge compression strength (and really, the spring compression strength) should be at least 50% times 16 pounds=8 pounds (lower bound), and must in all events be less than 16 pounds.

All of the foregoing may be summarized by saying that when bow system 1 is in an undrawn state, the outer bow grip 11 is pressured by spring 53 into a rearward position relative to inner bow handle 31 because the spring pressure exceeds the draw pressure; but when bow system 1 is drawn into in a drawn state, pressure from the draw overcomes the pressure from spring 53 so as to move outer bow grip 11 into a forward position relative to said inner bow handle 31 precisely because the draw pressure now exceeds the spring pressure.

Also schematically illustrated in FIG. 6 is a spring lock 184 which locks the spring cartridge 51 and spring 53 into the contracted position shown in FIG. 6 so that no extension and contraction of the pin 34 and pin head 36 is permitted in response to the bow system 1 being drawn and undrawn. This is not part of the first embodiment of FIGS. 5 and 6, but rather is used to implement a third preferred embodiment that combines the first preferred embodiment of FIGS. 5 and 6 with the second preferred embodiment of FIGS. 18 and 19. This will be elaborated in the later discussion of FIGS. 18 and 19.

Figure 7:
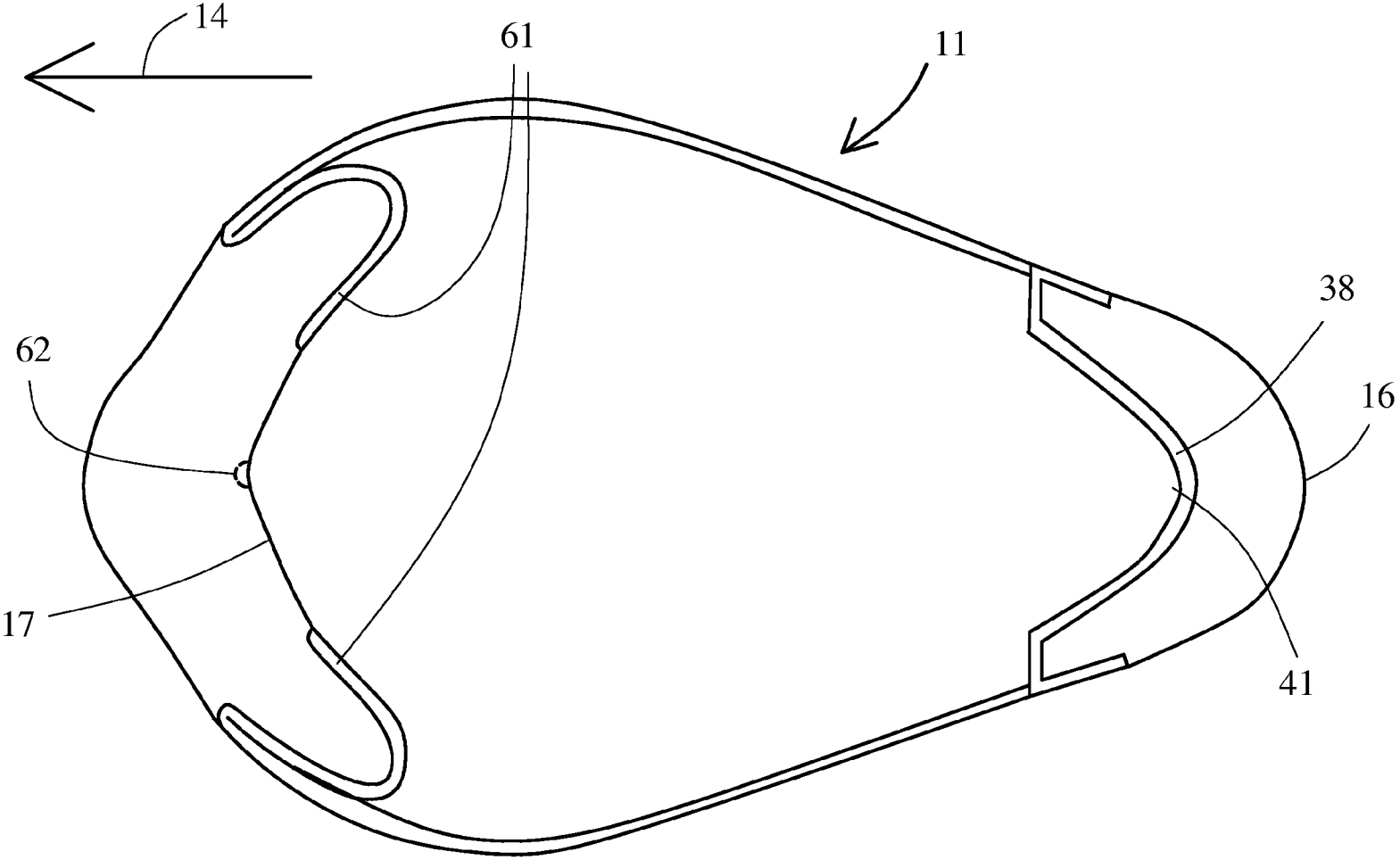
FIG. 7 is a top-down cross sectional view showing the outer bow grip of FIGS. 5 and 6 all by itself, as a distinct element of the embodiment of FIGS. 5 and 6. Also added in this figure is a ball recess variation of a mating feature between the outer bow grip and the inner bow handle.
Figure 8:
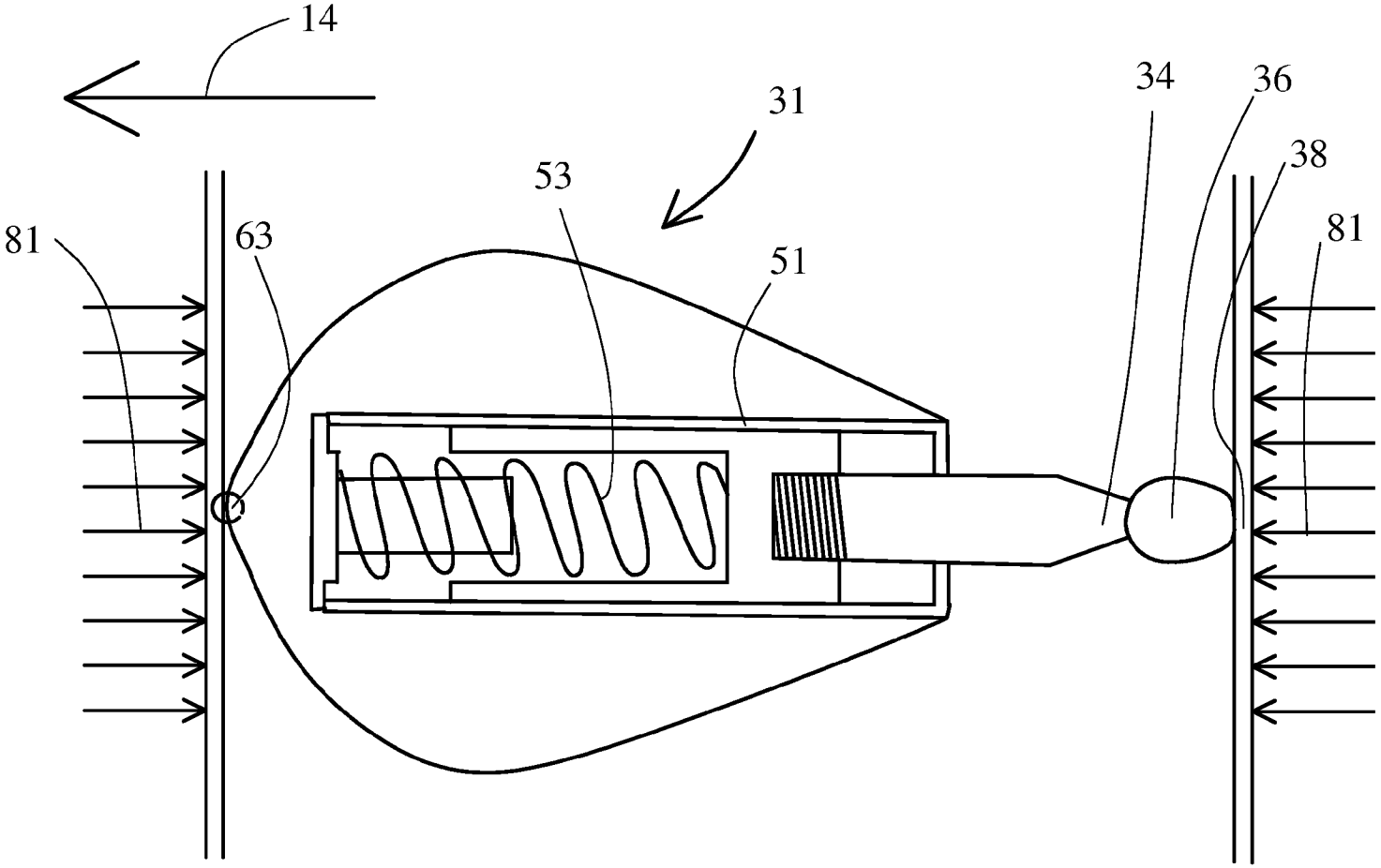
FIG. 8 is a top-down cross sectional view showing the inner bow handle of FIGS. 5 and 6 all by itself, as a distinct element of the embodiment of FIGS. 5 and 6, in its uncompressed state of FIGS. 3 and 5 which corresponds to an undrawn bowstring as in FIG. 1, and with the pressures that are applied to move this inner bow handle from the uncompressed state of FIG. 8 to the compressed state of FIG. 9. Also added in this figure is retractable ball which mates with the ball recess of FIG. 7.
Figure 9:
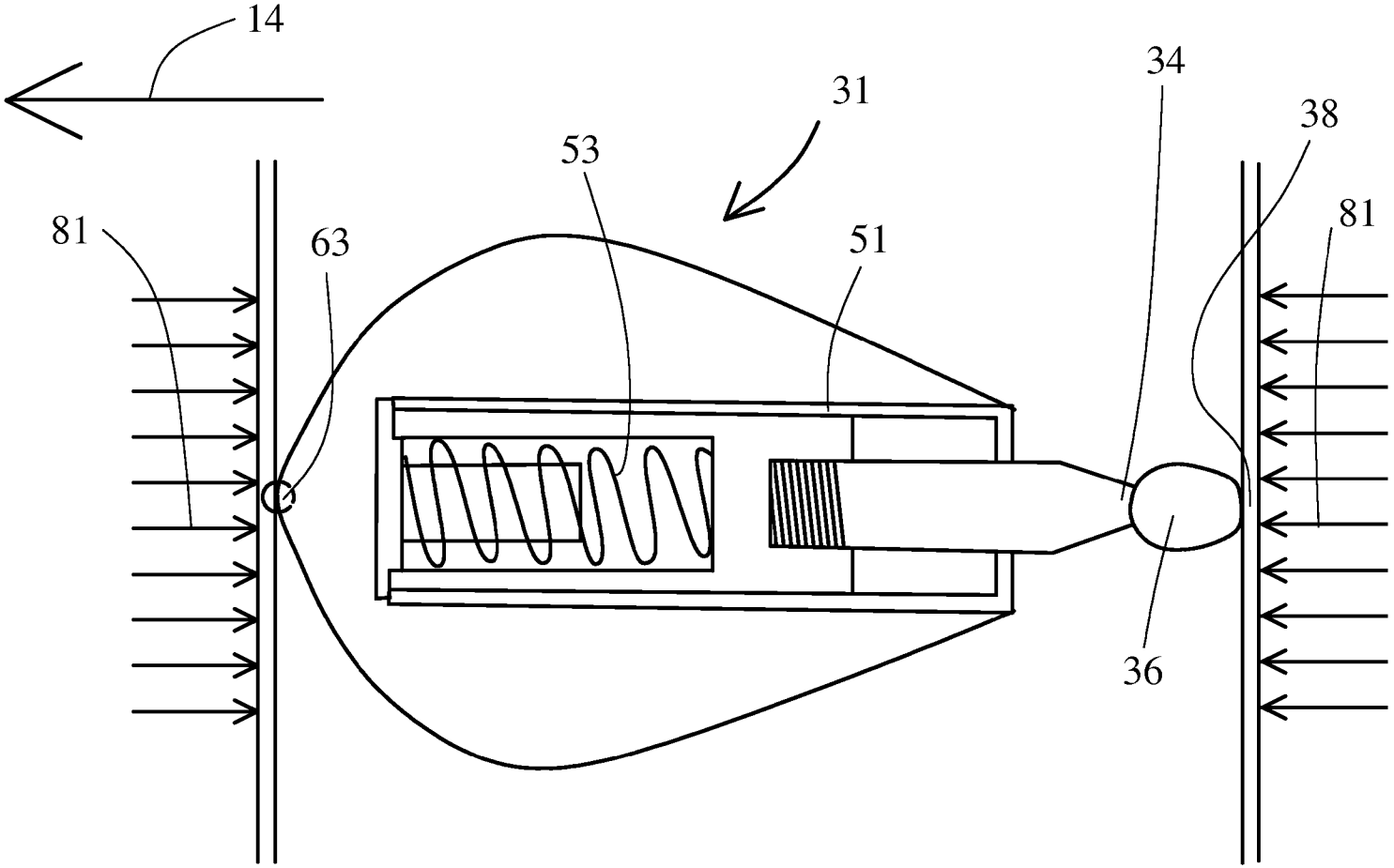
FIG. 9 is a top-down cross sectional view also showing the inner bow handle of FIGS. 5 and 6 all by itself, as a distinct element of the embodiment of FIGS. 5 and 6, but in its compressed state of FIGS. 4 and 6 which corresponds to a drawn bowstring as in FIG. 2, also with applied pressures.

It is helpful to now examine to FIGS. 7 through 9, which all provide further illustration of the embodiment of FIGS. 5 and 6. FIG. 7 shows the outer bow grip 11 of FIGS. 5 and 6 all by itself, as a distinct element of the embodiment of FIGS. 5 and 6. FIG. 8 shows the inner bow handle 31 of FIGS. 5 and 6 all by itself, as a distinct element of the embodiment of FIGS. 5 and 6, in its uncompressed state of FIGS. 3 and 5 which corresponds to an undrawn bowstring 13 as in FIG. 1. FIG. 9 also shows the inner bow handle 31 of FIGS. 5 and 6 all by itself, as a distinct element of the embodiment of FIGS. 5 and 6, but in its compressed state of FIGS. 4 and 6 which corresponds to a drawn bowstring 13 as in FIG. 2.

In FIG. 7, we see the outer bow grip 11 of FIGS. 5 and 6 all by itself. This outer bow grip 11 in isolation does not change its configuration at between the drawn and undrawn states of the bow system 1. Rather, it is the inner bow handle 31 of FIGS. 8 and 9 which changes configuration as between an undrawn, uncompressed (FIG. 8) and a drawn, compressed (FIG. 9) configuration. Key aspects of the outer bow grip 11 that are explicitly referenced in FIG. 7 are the rear pin pressure socket 38 which at its rearmost extremity provides the rotational fulcrum at 41, the forward hand-pressure region 16, and the inner front bumper 17. Also referenced are rotation range limiting surfaces 61 and an optional inner front mating feature 62. In FIGS. 7 through 9, inner front mating feature 62 is illustrated in two embodiments which may be employed separately or in combination. In a first embodiment, this is in the form of the illustrated nook that is smoothly continuous with mating bumper 17. In a second embodiment, this is in the form of a ball-détente or similar system as shown by the ball recess in FIG. 7 at 62 (where the nook curves most sharply) which mates with a spring-actuated retractable ball in FIGS. 8 and 9 at 63.

All of the features referenced in FIG. 7 serve to affect the way in which the inner bow handle 31 operates relative to outer bow grip 11 when the bowstring is both undrawn and drawn. In FIG. 8 we see the inner bow handle 31 of FIGS. 5 and 6 as a distinct element, prior to pressure being applied, but with those pressures schematically indicated by schematic pressure surfaces 81. These schematic pressure surfaces 81 represent the compression pressures which are longitudinally-applied to the front and rear ends of inner bow handle 31 by the various referenced parts of the outer bow grip 11 in FIG. 7. Specifically, rear pin pressure socket at 38 serves to apply a forward pressure 81 to pin head 36 at the rear of pin 34. Further, because inner bow handle 31 is integral with the bow 12, see FIGS. 3 and 4, and because the bow in turn is operatively interconnected with the bow string 13, see FIGS. 1 and 2, the rearward draw of the bowstring as in FIG. 2 inherently causes a rearward pressure 81 to be applied to all of inner bow handle 31. Although rearward pressure 81 is schematically depicted in FIGS. 8 and 9 as being applied to the front portion of inner bow handle 31, this is a schematic illustration of this pressure, and it is be understood that this rearward pressure is applied not at a single forward locale, but is a general pressure applied to the entirety of inner bow handle 31 by the very act of drawing back the bowstring 13.

The upshot of all of these schematic pressures shown in FIG. 8 is to make clear that as the bowstring 13 is drawn back, the effective pressures applied will squeeze the inner bow handle 31 from both the front and the rear. So what happens under this longitudinal, inward squeezing? Once the pressure from the draw of the bow system 1 exceeds the compression strength of spring cartridge 51, the spring 53 will compress, the distance between the two schematic compression surfaces 81 will diminish, this diminution in front-to-rear expanse of the inner bow handle 31 will also cause (if it is included) the optional rotation damper 52 of FIG. 13 to be compressed into a configuration such that it smoothes out the pivoting motion, and overall, this compression pressure will cause the combination of spring cartridge 51 and rotation damper 52 to physically compress from the expanded uncompressed configuration illustrated by FIGS. 8 and 12, to the contracted compressed configuration of FIGS. 9 and 13. But because pin head 36 remains seated throughout against rear pin pressure socket schematically represented at 38, this compression will manifest by a rearward movement of inner bow handle 31 relative to outer bow grip 11, which causes the configuration of FIG. 5 to convert into that of FIG. 6. FIG. 11 to be discussed further below, also illustrates from a complementary view via directional arrow 111, the respective rearward and forward movement of pin 34 and pin head 36 within spring cartridge 51 in accordance with FIGS. 8 and 9.

With this in mind, now let us return to FIGS. 6 and 13, which show the cross section while the bow system 1 is fully drawn, with spring cartridge 51 and (in FIG. 13) rotation damper 52 physically compressed, and with the contact now broken/relieved between inner front bumper 17 and front riser surface 54. Because this point of contact is now broken, it becomes possible for outer bow grip 11 to rotate/pivot 33 about inner bow handle 31 while inner bow handle 31 remains aimed along the direction-of-flight arrow 14, and while optional rotation damper 52 smoothes out the pivoting in the region where it is situated. Once this configuration is reached, while rotation is now permitted, as previously noted this rotation will be limited to a predetermined limited range of rotation designated over angle 33. As will be seen from FIG. 6, this rotational limit is established and enforced by rotation range limiting surfaces 61. Specifically, as outer bow grip 11 rotates/pivots 33 in one direction or the other about inner bow handle 31, the rotation range limiting surfaces 61 of outer bow grip 11 will, at a certain predetermined limiting rotational angle, come into contact with the front side surfaces 64 of inner bow handle 31, which contact will limit any further rotation. In the embodiment of FIGS. 5 and 6, this is how rotation is limited. Thus, it will be appreciated that the permitted play in rotation angle 33 is established by how the precise positioning of rotation range limiting surfaces 61 as well as the width between front side surfaces 64 is chosen. It will be apparent to someone of ordinary skill that variations on this approach may be used for limiting rotation, all within the scope of this disclosure and the associated claims.

As earlier stated, it is desirable to maximize this permitted range of rotation 33 about fulcrum 41, by making the inner bow handle 31 as thin as possible consistent with ensuring that the bow 12 and inner bow handle 31 maintain structural integrity in view of the pressures they must sustain when the bow system 1 is repetitively drawn and released for shooting, and by making the outer bow grip 11 as wide as possible consistent with a controlled, ergonomically-desirable grip surface for the archer's forward hand. In FIG. 6, it is clear that the rotational range will be limited by contact between rotation range limiting surfaces 61 of outer bow grip 11 and the front side surfaces 64 of inner bow handle 31. Thus, it should be equally clear that by adjusting or even eliminating the rotation range limiting surfaces 61 so that rotation will be limited simply by the sides of outer bow grip 11, the invention may be fabricated to enable maximize this range as much as is desired, again, consistent with structural integrity and optimum ergonomics.

Once the bowstring 13 is released to propel an arrow shot and the spring cartridge 51 and optional rotation damper 52 re-expand to reseat the outer bow grip 11 back together with the inner bow handle 31 along front bumper 17 and front riser surface 54, the bow system 1 will return to the undrawn configuration of FIGS. 1, 3 and 5. Now, inner front mating feature 62 of outer bow grip 11 and a complementary front mating feature 63 of inner bow handle 31 come into play. Specifically, as the configuration of FIG. 6 returns to that of FIG. 5, these complementary mating features 62 and 63 will not only cause outer bow grip 11 and inner bow handle 31 to come back into contact along inner front bumper 17 and front riser surface 54, but under the expansion pressure from spring cartridge 51, will also cause outer bow grip 11 and inner bow handle 31 to smoothly shift from any rotational misalignment due to rotation of the archer's front hand, back into complete rotational alignment as shown in FIG. 5, wherein outer bow grip 11 and inner bow handle 31 become substantially-centered at their front contact position. Then, the next time the bow system 1 is to be used, the outer bow grip 11 and inner bow handle 31 will be properly aligned and centered, as if they are one and the same, and the cycle from the undrawn bow system 1 of FIG. 1, to the drawn bow system 1 of FIG. 2, through the release of the bowstring 3 and the return to an undrawn configuration, can be iteratively started over once again.

Figure 10:
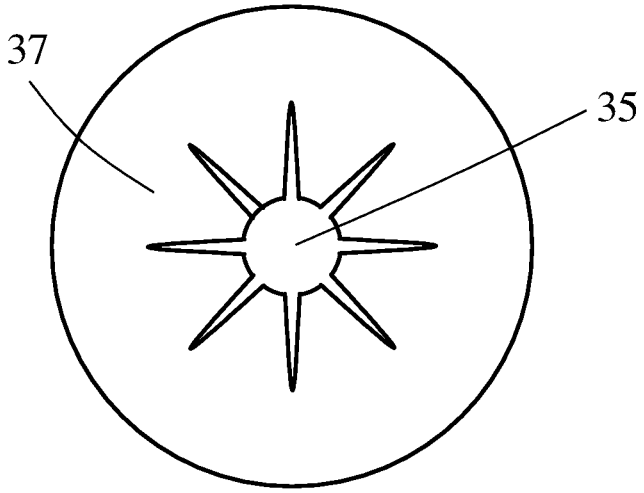
FIG. 10 is a plan view of a split ring embodiment of a flexible aperture element used in accordance with several embodiments of the invention.

FIG. 10 is a plan view of a split ring embodiment of flexible aperture element 37. It will be appreciated when FIG. 10 is contrasted particularly with FIG. 6, that the flexibility of flexible aperture element 37 provides the necessary play for the pivoting illustrated in FIG. 6, and how flexible aperture element 37 in combination with optional rotation damper 52 to be discussed in FIG. 12 provides both the necessary freedom for pin 34 to pivot through pin aperture 35 and flexible aperture element 37 in a smoothly-damped fashion. As a variation on the flexible aperture, one may also use a fixed aperture with a keyhole configuration (rounded aperture with larger than the pin head 36 diameter with a narrowed slit smaller than pin head 36 diameter, enabling the pin head to be passed through the wide portion of the keyhole then seated in the narrow portion), not shown. It is to also be understood that the specific embodiment of FIGS. 5 through 9 combining all of these referenced elements is but one of a number of embodiments that will become apparent to someone of ordinary skill in the art for effectuating a smooth pivot about the pivot fulcrum 41, once this disclosure has been understood. And, it is to be understood that all such alternative embodiments are also regarded so as to fall within the scope of this disclosure and its associated claims.

FIG. 11 further details FIGS. 8 and 9 along views 8-8 and 9-9 as utilized in the embodiments of FIGS. 5 through 9 and 12 and 13, and in particular, shows the placement of spring cartridge 51 within inner bow handle 31 as well as the movement of pin 34 and pin head 36 in and out of spring cartridge 51 depending on the draw state of bow system 1. It also illustrates the placement of pin 34 and pin head 36 through the pin aperture 35 of optional flexible aperture element 37, which will be further elaborated in FIGS. 12 and 13. Because FIGS. 5 and 6 as well as 12 and 13 are horizontal cross sections, they do not illustrate the manner in which this two-point-of-contact configuration is replicated by the placement of one or more (preferably two) spring cartridges within the inner bow handle. It will be appreciated how this provides vertical stability. We also see from FIG. 11 that there are one or more (preferably two) horizontal openings drilled or otherwise fabricated into inner bow handle 31 from the rear, within which a spring cartridge 51 is firmly seated. One may choose to make this seating immobile with durable glues/epoxies in combination with a very tight geometric fitting, but it is preferred to simply have tight yet removable seating so that in the event the spring cartridge 51 breaks or malfunctions, it can be modularly removed and replaced. Ideally, this can be archived by a tight but removable fitting, and optionally, by a screw-in or similar type of fitting.

The dynamical operation of the system in relation to the draw state of the bow system 1 is illustrated in FIG. 11 by directional arrow 111 which shows the respective rearward and forward movement of pin(s) 34 and pin head(s) 36 within spring cartridge(s) 51 in accordance with FIGS. 5 and 6 and also, FIGS. 8, 9, 11 and 12. In particular, when the bow system 1 is undrawn, then as shown in FIGS. 5 and 8, the pin(s) 34 and pin head(s) 36 are pressed by spring(s) 53 into a rearward position to more substantially protrude from the rear of spring cartridge(s) 51 and inner bow handle 31, which simultaneously means that inner bow handle 31 is in a forward position relative to outer bow grip 11 so as to bar rotation. Conversely, when the bow system 1 is drawn, then as shown in FIGS. 6 and 9, the draw pressure overcomes the spring pressure and the pin(s) 34 and pin head(s) 36 are pressed by this draw pressure into a forward position so as to have a lesser protrusion from and deeper penetration into the rear of spring cartridge(s) 51 and inner bow handle 31. Simultaneously, this means that inner bow handle 31 is now in a rearward position relative to outer bow grip 11, so as to enable the limited rotation 33. Again, while it is possible to employ only one spring cartridge 51, the preference is to employ two in order to provide vertical stability for the outer bow grip 11 in relation to inner bow handle 31, thus ensuring that the only permitted movement is the rotation 33 about the long vertical axis 32 of bow 12. And as has been already stated, while spring cartridge 51 is a preferred embodiment, one may choose within the scope of this invention to implement this functionality by a simple spring, or by any equivalent apparatus known or which may become known in the art which exerts an outward force when pressed inward from an expanded position thereof and returns to said expanded position when said inward pressing is relieved. Two such variations on the spring mechanism will be discussed in connection with FIGS. 14 through 17.

FIGS. 12 and 13 which have previously been summarized, illustrate the utilization of the optional flexible aperture element 37 and rotation damper 52. We now explain in detail the function of these optional elements. The purpose of flexible aperture element 37 (which as noted above can take other forms such as a keyhole) is to guide the pin head 36 into a proper seating at the rear of rear pin pressure socket 38. The flexibility of flexible aperture element 37 is not an aid for pivoting/rotating, but only a means to allow the slightly-larger diameter of pin head 36 to pass therethrough and fit securely and centered into rear pin pressure socket 38. At the same time, the diameter of flexible aperture element 37 is slightly larger than that of the portion of pin 34 which passes therethrough, which is necessary so as to not hinder proper pivoting of outer bow grip 11 about inner bow handle 31.

Because the apertures need to be slightly larger in diameter as just noted, rotation damper 52 operates as a fitted "ring" or "donut" which fully contacts the pin. It will thus be seen when contrasting FIGS. 12 and 13 that when rotation damper 52 is compressed as in FIG. 13, it will provide what is in the nature of a commoving aperture, that is, the center of this "ring" or "donut" will glide smoothly with the rotation, will not impede the rotation, and will provide a controlled movement to help the pin head 36 stay centered. This optional flexible compressible rotation damper 52 needs to be compressible and springiness, and have suitable pliable material characteristics to enable a smooth pivot.

Figure 15:
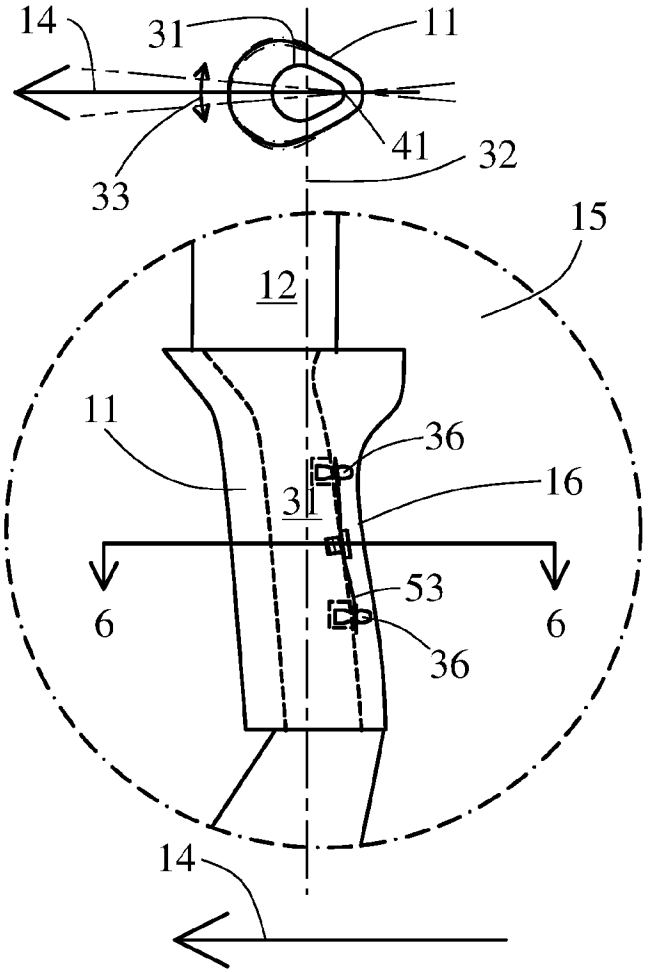
FIG. 15 is a side plan view the first alternative spring mechanism embodiment of FIG. 14 when the invention is in a drawn position.
Figure 14:
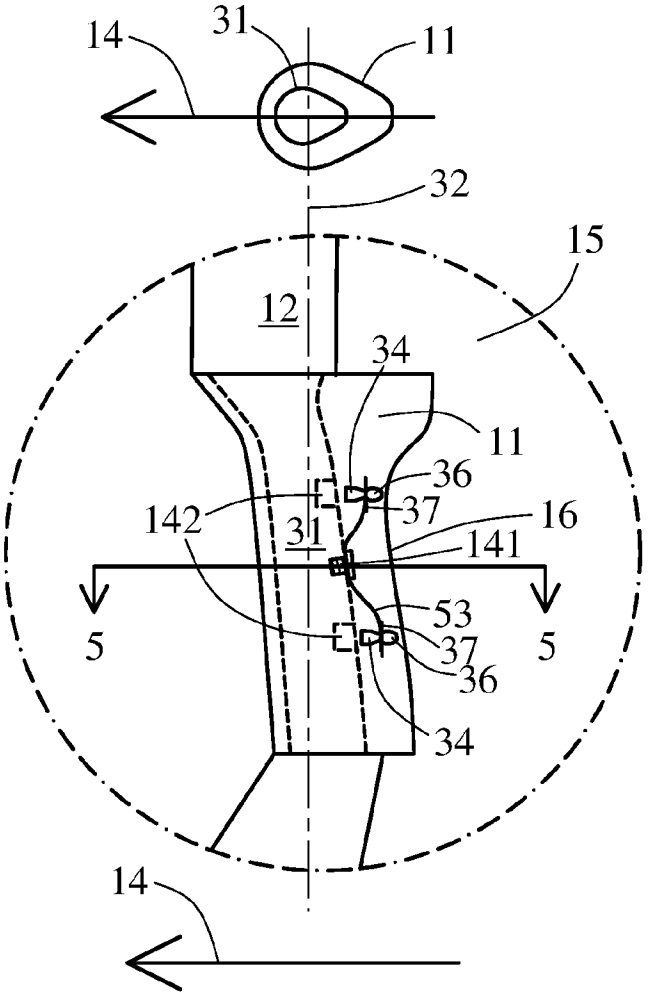
FIG. 14 is a side plan view illustrating a first alternative preferred embodiment for the spring mechanism of the invention, when the invention is in a non-drawn position.

FIGS. 14 and 15 illustrate a first alternative preferred embodiment for the spring mechanism of the invention, when the invention is in respective non-drawn and drawn positions. The spring cartridge 51 illustrated in FIGS. 5, 6, 8, 9, 11, 12 and 13 as a specific means to facilitate the relative alignments between the outer bow grip and an inner bow handle as described in FIGS. 3 and 4, is instead replaced by the spring mechanism of FIGS. 14 and 15, as will now be described.

In FIG. 14 we see two pins 34 and pin heads 36 as before. There are also two reduced pin apertures 142 which have a smaller (reduced) penetration into the inner bow handle 31 than does the spring cartridge 51 as illustrated particularly in FIG. 11. That is, the pin apertures 142 are not drilled as deeply into inner bow handle 31 as are the spring cartridges 51 shown in FIG. 11. By lessening the depth of this penetration, the structural, material integrity of inner bow handle 31 is increased under the stresses of repeated use. Further, in contrast to what has been previously illustrated and described, these pins 34 also have a shorter length and so are not always recessed into the inner bow handle 31. Rather they move between the non-recessed configuration of FIG. 14 and the recessed configuration of FIG. 15 in synchrony with whether the bow system 1 is not drawn and drawn.

The spring 53 is now in the form of a bowspring rather than the linear spring earlier illustrated, and is permanently fixed to the inner bow handle 31 with a spring anchor 141 which may, for example not limitation, be a simple retention screw as illustrated. When no pressure is applied from a draw, spring 53 naturally holds the pins 34 and pin heads 36 with a rearward disposition which is not recessed into the reduced pin apertures 142, as is seen in FIG. 14. When a draw pressure is applied, the pin heads 36 are pressed forward, the spring 53 is compressed, and the pins become recessed into the reduced pin apertures 142, as is seen in FIG. 15. The flexible aperture element 37 has also been illustrated, so that this can be contrasted to the position of this same flexible aperture element 37 in the top-down cross section views of FIGS. 11 and 12.

All of what is illustrated in FIGS. 14 and 15 (and also FIGS. 16 and 17 to be discussed momentarily) is simply an alternative way of providing a spring pressure to the pins 34 and pin heads 36; in all other material respects beyond the specifics of the spring mechanism, the invention works in exactly the same manner as has been previously described. While this spring mechanism is in fact hidden from view, it has been illustrated in solid not hidden lines, because this is it particular feature sought to be highlighted in the illustrations of FIGS. 14 and 15.

Figure 17:
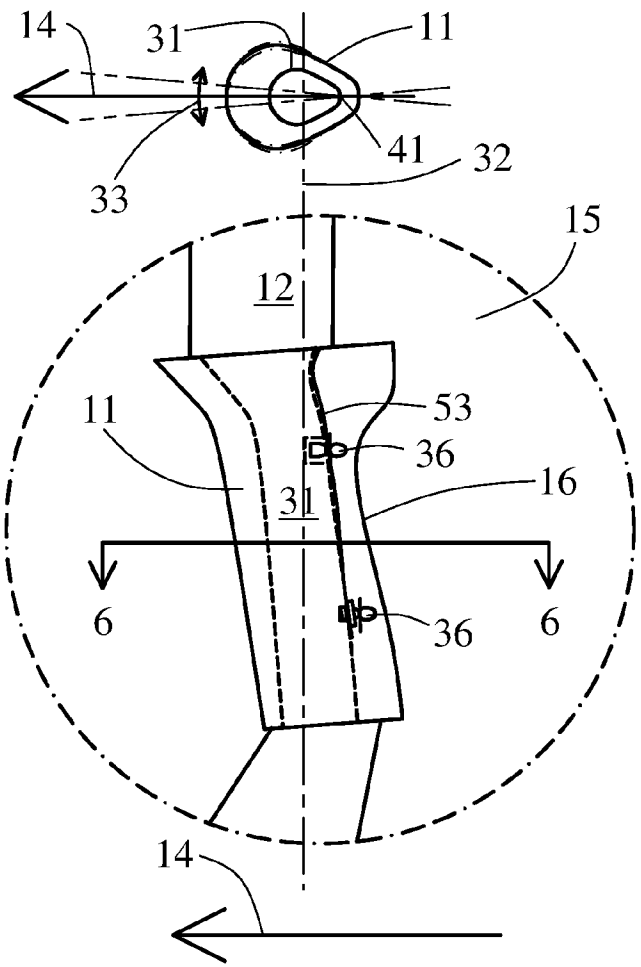
FIG. 17 is a side plan view the second alternative spring mechanism embodiment of FIG. 16 when the invention is in a drawn position.
Figure 16:
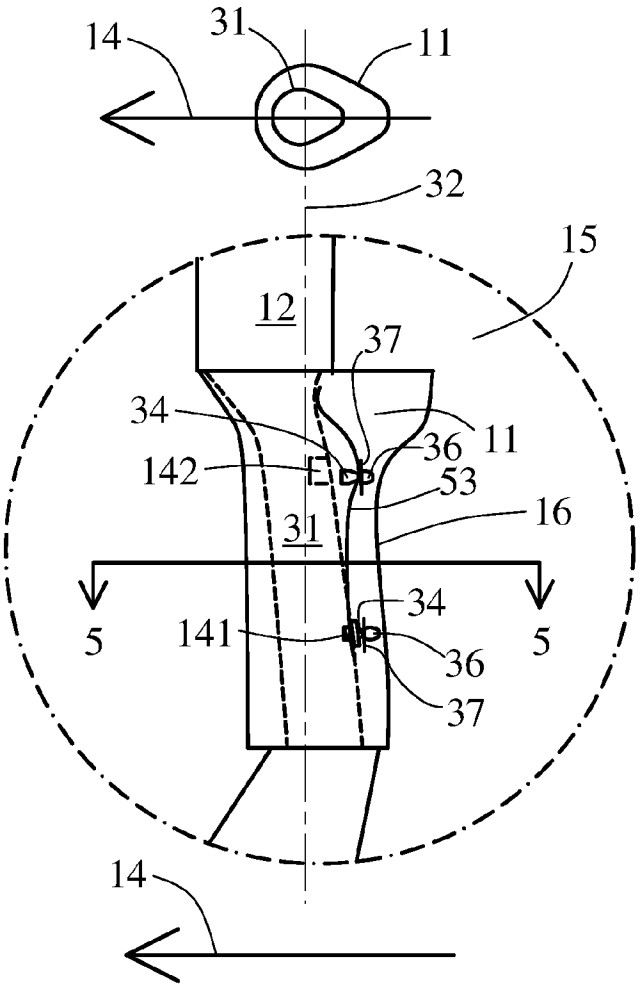
FIG. 16 is a side plan view illustrating a second alternative preferred embodiment for the spring mechanism of the invention, when the invention is in a non-drawn position.

FIGS. 16 and 17 illustrate a second alternative preferred embodiment for the spring mechanism of the invention, when the invention is in respective non-drawn and drawn positions, and is simply a further variant of what was just described in FIGS. 14 and 15. This variation still uses two pins 34 and pin heads 36, but the lower pin 34 is permanently anchored 141 into the inner bow handle 31 together with and at the same locale as spring 53 which is a modified bowspring. There is now a single reduced pin aperture 142 rather than two, which strengthens the structural material integrity of inner bow handle 31 under repeated use stress by eliminating one drill point. The upper pin 34 and pin head 36 move between the non-recessed configuration of FIG. 16 and the recessed configuration of FIG. 17 in synchrony with whether the bow system 1 is not drawn and drawn, just as in FIGS. 14 and 15. This spring 53 assumes the configuration of FIG. 16 when no pressure is applied. But when the bow system 1 is drawn, spring 53 compresses as shown in FIG. 17 and so exerts a rearward pressure on upper pin 34 and pin head 36.

This variation relies on the fact that it is preferable to have two rear points of contact for the outer bow grip 11 to pivot around inner bow handle 31 when the bow system is drawn as has been previously described; but that it is also sufficient to have a single pin head 36—specifically the upper pin head 36 as illustrated in FIG. 16—pressing together the front surfaces of outer bow grip 11 inner bow handle 31 when the bow system is not drawn. In other words, referring to FIGS. 12 and 13 (which fully apply here except for the difference in the specific embodiment of the spring mechanism), when the bow system 1 is drawn as in FIG. 13 it is preferred to have two points of contact vertically-displaced from one another between pin heads 36 and rear pin pressure socket 38 to ensure good rotation about the fulcrum 41 (i.e., about the vertical axis 32) without any relative movement other than this rotation (i.e., without any rotation about a horizontal axis). But when the bow system 1 is not drawn as in FIG. 12, it will suffice to only have one pin head 36 pressing back on rear pin pressure socket 38 to seat the front riser surface 54 against the inner front bumper 17 so that outer bow grip 11 and inner bow handle 31 now coact as a unitary system without any relative movement between them, as previously discussed at length. Note that in this embodiment configuration there is a slight forward "woodpecker" type pivot of the outer bow grip 11 relative to inner bow handle 31 which emanates from the forward and backward movement of the upper pin head 36. This pivot is exaggerated (not drawn to scale) in these two Figures, simply to highlight the overall configuration and operation of this embodiment, and is so slight that it does not adversely impact the method of the user drawing the bow system 1 and then firing with accuracy.

Again, all of what is illustrated in FIGS. 16 and 17 is simply an alternative way of providing a spring pressure for the pins 34 and pin heads 36. In all other material respects beyond the specifics of the spring mechanism, the invention works in exactly the same manner as has been previously described. Having shown several variations for implementing this spring mechanism, it will be apparent that other variations might also be developed by someone of ordinary skill in the art, all within the scope of this disclosure and its associated claims.

Ideally, because one design objective is to minimize material stresses on inner bow handle 31 during repeated use, it is desirable to minimize the number of apertures 142 (and at 141, see also 53 in FIG. 11) which need to be drilled into inner bow handle 31, and to make these apertures as small (shallow) as possible. With this in mind, if the spatial relationships between the outer bow grip 11 inner bow handle 31 are carefully designed and engineered in manufactured implementations of the invention, following the approach of FIGS. 14 through 17, and using welds or suitable glues or epoxies or other attachment means in place of retention screws 141 to secure the springs 53, it may well become possible to entirely eliminate the need for any drilling at all into inner bow handle 31, thereby maximizing structural integrity.

In these embodiments of FIGS. 14 through 17, the inner bow handle 31 comprises a spring or equivalent apparatus 53 rearwardly-disposed thereon, with a pin 34 connected to the spring 53 such that said spring 53 applies rearward pressure against the pin 34. The rear end of the pin (pin head 36) contacts the rear pin pressure socket 38 of the outer bow grip 11, and the spring 53 continues to have a spring compression strength less than a maximal extension strength of the bow system 1. Therefore, when the bow system 1 is in its undrawn state, the pin 34 is pressed by the spring 53 into a rearward position such that said outer bow grip 11 is pressured by the spring 53 into a rearward position relative to the inner bow handle 31 to prevent relative rotation of the outer bow grip 11 about the inner bow handle 31. Further, when the bow system 1 is drawn into in the drawn state, the pin 34 is pressed by the draw pressure into a forward position such that the outer bow grip 11 is moved by the draw pressure into a forward position relative to the inner bow handle 31 to enable the relative rotation. In contrast to the embodiments of FIGS. 5, 6, 8, 9, 11, 12 and 13, all of this occurs without penetration of the pin 34 into the inner bow handle 31, and so reduces or—with good engineering within the purview of persons of ordinary skill—entirely eliminates the need for any drilling at all into the inner bow handle 31.

Figure 18:
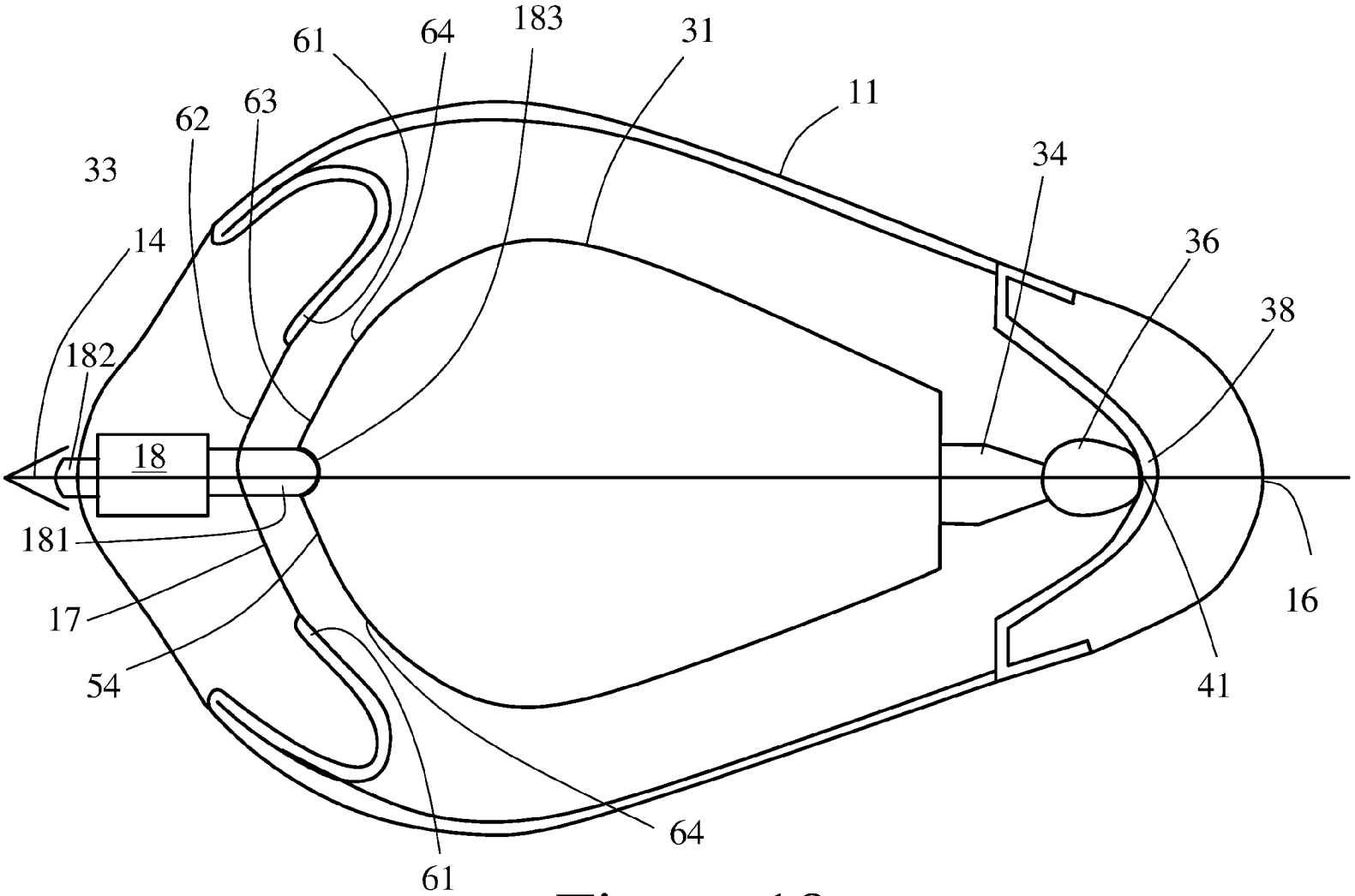
FIG. 18 is a top-down cross sectional view taken over the plane designated as 18-18 in FIG. 3, and is a second preferred embodiment for the inventive principle schematically illustrated by the projection at the top of FIG. 3 when the bow system is in the non-drawn position of FIG. 1.
Figure 19:
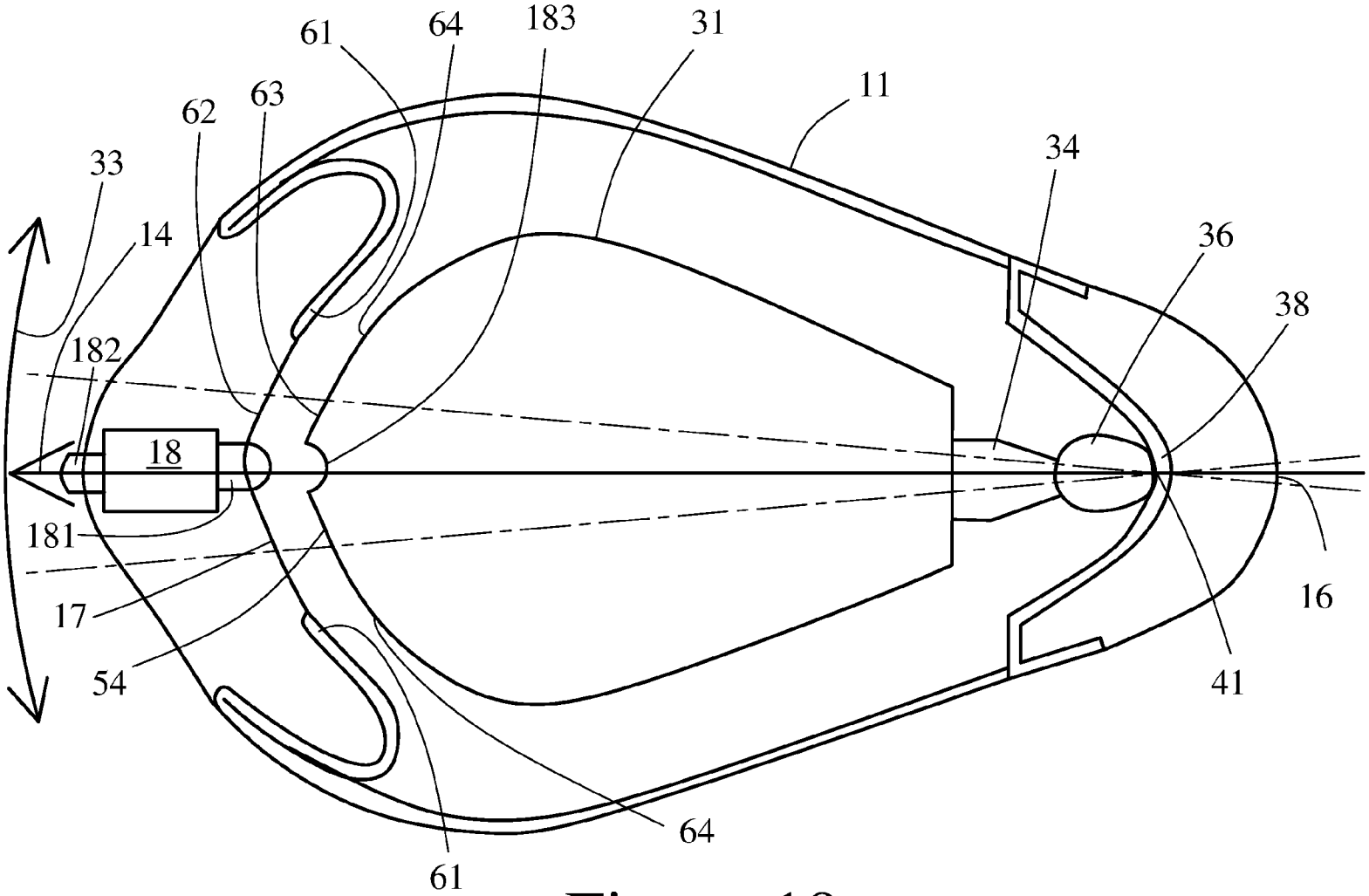
FIG. 19 is a top-down cross sectional view taken over the plane designated as 19-19 in FIG. 4, and is the second preferred embodiment for the inventive principle schematically illustrated by the projection at the top of FIG. 4 when the bow system is in the drawn position of FIG. 2.

FIGS. 18 and 19 respectively illustrate a second preferred embodiment for the inventive principles respectively schematically illustrated by the projection at the top of FIGS. 3 and 4. Whereas the first preferred embodiment initially illustrated in FIGS. 5 and 6 and thereafter in some further variants illustrated in FIGS. 14 through 17 all made use of a spring 53 rearwardly-disposed in and/or on the inner bow handle 31, the second preferred embodiment of FIGS. 18 and 19 makes use of a user-actuated retractable lock system 18 preferably situated at the front of the outer bow grip 11 and engaging the inner bow handle 31 from the front.

This user-actuated retractable lock system 18 (which is schematically illustrated and not drawn to scale) comprises an actuator 182 and a retractable restraining tip 181, with the actuator 182 actuated at will directly by the user's front hand when that hand is placed on the outer bow grip 11. This retractable lock system 18, which is a preferred albeit non-limiting mechanism for this second preferred embodiment, operates in precisely the same fashion as does the ratchet and spring mechanism of a retractable pen, see, for example, http://www.quora.com/How-does-the-click-pen-or-retractable-pen-work, http://www.ehow.com/how-does_5553922_retractable-ballpoint-pen-works.html, and http://vimeo.com/20360380, as well as other variants of this mechanism which are known or may become known in the art. Of course, the pressures associated with drawing and releasing bow system 1 are much greater than those encountered in using a pen, so this mechanism will need to be a hardened and sturdier version of the retractable pen mechanism. But the operating principles are identical. FIG. 18 illustrates this retractable lock system 18 in an extended configuration, while FIG. 19 illustrates this same retractable lock system 18 in a retracted configuration.

So in view of what has already been disclosed, FIGS. 18 and 19 will be most easily be appreciated by thinking of the combination of 18, 181 and 182 as a hardened, sturdy retractable ballpoint pen in which the numbered element 18 is the pen barrel, element 181 is the writing ballpoint tip of the pen, and element 182 is the actuator button which the user presses with his or her thumb or a finger (preferably the index finger) to retract and extend the ballpoint tip. The ratchet and spring mechanism is contained inside the barrel and not seen externally, but the functionality of extension and retraction and how this is achieved is well understood in the art.

So thinking of 18, 181 and 182 as comprising the same mechanism as that of a sturdy, hardened retractable ballpoint pen, the user-actuated retractable lock system 18 either restrains or enables relative rotation between the outer bow grip 11 and the inner bow handle 31 by engagement and disengagement between the restraining tip 181 and a restraining nook 183 situated on the inner bow handle 31. In FIG. 18, this pen-like retractable lock system 18 is in a state whereby the restraining tip 181 is in an extended position, analogously to the tip of a pen being extended for writing. And specifically, the restraining tip 181 in its extended position is seated within restraining nook 183 so as to restrain any relative rotation between the outer bow grip 11 and the inner bow handle 31. In FIG. 19, in contrast, retractable lock system 18 is in a state whereby the restraining tip 181 is in a retracted position, analogously to the tip of a pen being retracted from writing so that ink does not smear onto unintended surfaces. And specifically, the restraining tip 181 is now retracted from its engagement with restraining nook 183, so that the restraint is removed. It is the removal of this restraint between restraining tip 181 and restraining nook 183 which now enables relative rotation 33 between the outer bow grip 11 and the inner bow handle 31 about fulcrum 41.

So just as FIGS. 5 and 6 initially illustrated the first preferred embodiment for the inventive principles laid out in FIGS. 3 and 4 by using a spring or equivalent apparatus 53 which exerts an outward force when compressed from an expanded position and returns to the expanded position when the inward compressing is relieved, FIGS. 18 and 19 illustrate the second preferred embodiment for the inventive principles laid out in FIGS. 3 and 4 by using an outer bow grip 11 comprising a retractable lock system 18 with an actuator 182 disposed on a front outside of the outer bow grip 11 and an retractable restraining tip 181 disposed on a rear inside of the outer bow grip 11, and an inner bow handle 31 comprising a restraining nook 183 for engaging with the retractable restraining tip 181. In both of these cases, the outer bow grip 11 is prevented or enabled from rotating relative to the inner bow handle 31 depending upon in the former case whether the outer bow grip 11 is or is not pressured by the spring 52 into a rearward position relative to the inner bow handle 31, and in the latter case whether the actuator 182 has been used to engage or disengage the restraining tip 181 with the restraining nook 183.

The method of using the second preferred embodiment of FIGS. 18 and 19 is the following: In general, when the restraining tip 181 is in its extended position as in FIG. 18, the outer bow grip 11 the inner bow handle 31 are locked to one another and the bow system 1 is indistinguishable from an ordinary bow system which does not employ this invention. So when bow system 1 is in the undrawn position, the user should depress the actuator 182 to ensure that restraining tip 181 is extended and thus engaged within restraining nook 183, if it is not already so-engaged. This is the "default," starting configuration for any use of bow system 1. Then, the user draws back on the bowstring 13 until the bow system 1 reaches the drawn configuration of FIG. 2. Here, because the spring 53 is not a part of this second preferred embodiment, the outer bow grip 11 the inner bow handle 31 will still locked to one another as in FIG. 18.

Now the user has a choice which is not available in the first preferred spring-based embodiment: If the user wishes to fire an arrow in the totally conventional fashion without enabling any pivot between outer bow grip 11 and inner bow handle 31, then the user will refrain from pressing on the actuator 182 entirely, so that restraining tip 181 and restraining nook 183 maintain their engagement and no rotation 33 is permitted. But if the user does wish to enable a relative rotation 33 between the outer bow grip 11 and the inner bow handle 31, the user will make the volitional decision to depress the actuator 182, so that the restraining tip 181 retracts and thus withdraws from its engagement with restraining nook 183, thereby enabling relative rotation 33 by unlocking the restraint between outer bow grip 11 and inner bow handle 31. This relative rotation will then absorb any rotational torque exerted by the user's front hand, in precisely the same manner that has been previously described for the first preferred embodiment. Then, when ready, the user fires the arrow, and the bow system 1 is returned to its undrawn configuration. Now, however, the rotation 33 is still permitted, because restraining tip 181 remains retracted from its engagement with restraining nook 183. So at some point in time prior to the next usage of the bow system, if the user wishes to lock the outer bow grip 11 and inner bow handle 31 together, the user depresses the actuator 182 once again, this time to extend restraining tip 181 and restore its restraining engagement with restraining nook 183.

Each of the first and second preferred embodiments (spring 53 or no spring 53) has its benefits, and the use of one over the other is a matter of user preference. The second (no spring) embodiment gives the archer complete control whether to use the bow system in the conventional manner with outer bow grip 11 and inner bow handle 31 locked together as one integral unit, or to make use of the torque-reduction features by unlocking outer bow grip 11 and inner bow handle 31. This is a high degree of flexibility and versatility. But, the user must take the deliberate, conscious step of depressing the actuator 182 in order to employ the torque reduction gained via the rotation 33. The first (with spring 53) embodiment does not give the archer this choice: whenever the bow system is drawn, the outer bow grip 11 and inner bow handle 31 will automatically become disengaged from one another, and so the rotation 33 will always be permitted. Thus, there is an automatic "toggling" between the locked and unlocked relationship between outer bow grip 11 and inner bow handle 31 which occurs automatically in response to, and simultaneously with, the bow system 1 being undrawn and drawn. This provides a seamless use of the bow system which does not require any deliberate act to depress any actuator: the simple act of drawing and releasing the bowstring 13 simultaneously serves to actuate and deactuate the torque reduction. But the choice of disabling the torque-reduction feature is removed from the user. Again, it is expected that the choice of one embodiment over the other by any individual archer will be matter of "feel" and "taste."

It is also important to point out that these first and second preferred embodiments (spring 53 or no spring 53) are not mutually exclusive, and that they can be merged together into one bow system 1 constituting a third preferred embodiment. Particularly, it will be noticed that the pin 34 and pin head 36 are positioned relative to inner bow handle 31 in FIGS. 18 and 19 in precisely the same way as these are relatively positioned in FIG. 6. The only difference is that FIG. 6 has a spring cartridge 51 and spring 53 whereas FIGS. 18 and 19 do not. This is where the earlier-mentioned spring lock 184 schematically shown in FIG. 6 comes into play.

Specifically, if a spring lock 184 in one of many variants known in the art is provided and suitably engineered into the system to enable the user, at will, to lock the spring cartridge 51 and spring 53 into the state of compression shown in FIG. 6 no matter what the draw state of the bow system 1 might be, then by adding the retractable lock system 18 with actuator 182 and retractable restraining tip 181 as well as the restraining nook 183 to the configuration in FIG. 6, one would identically have the operational configuration of FIGS. 18 and 19, with the restraining tip 181 and restraining nook 183 simultaneously doubling as a variant of the complementary mating features 62 and 63 shown and discussed in FIGS. 7 through 9. Then the user would have the ability to decide at any time, from one shot to the next, whether the torque-balancing features are or are not employed, and would thus have the best of both worlds from the first and second preferred embodiments.

In this third preferred embodiment, if the archer wants to use the bow system 1 at any given time in accordance with the first preferred embodiment (the torque balancing is automatically actuated when the bow system 1 is drawn), then he or she would deactivate the spring lock 184 so that spring cartridge 51 and spring 53 expand or contract in unison with the bow system 1 being drawn or undrawn, and would also use actuator 182 retract the restraining tip 181. Then when the bow is undrawn the system would be in the configuration of FIG. 5 with the tip 181 and restraining nook 183 acting as the complementary mating features 62 and 63 to properly align the rotational relationship between outer bow grip 11 and inner bow handle 31. And when the bow is drawn the system would move into the configuration of FIG. 6, enabling torque-balancing rotation between outer bow grip 11 and inner bow handle 31 to be automatically provided synchronously with the bow system 1 being drawn, with the tip 181 remaining retracted and so not interfering with the rotation 33.

Also in this third preferred embodiment, if the archer wants to use the bow system 1 at any given time in accordance with the second preferred embodiment, then he or she would activate the spring lock 184 so that the pin 34 and pin head 36 are fixedly positioned relative to inner bow handle 31 precisely as in FIGS. 18 and 19 for the duration of the time during which the spring lock 184 is activated. Then the user can proceed to use the bow system precisely in accordance with the second, rather than the first, preferred embodiment.

We now turn generally to discuss some other aspects of the invention.

Insofar as materials for fabrication, it is preferred though not required that outer bow grip 11 comprise a spring steel or stainless steel. One may also use variety of hard plastics. Spring cartridge 51 preferably comprises Teflon, aluminum, and/or stainless steel. The spring 53 itself may comprise any suitable spring material. The optional flexible compressible doughnut-shaped rotation damper 52 needs to have suitable pliable material characteristics to enable a smooth pivot. Such materials would include, but are not limited to, soft rubber, silicon, and urethane. The inner bow handle 31 may be fabricated from any material normally used for a bow riser, however, in any embodiment such as that of that of FIG. 11 in which a horizontal opening is drilled or otherwise fabricated into inner bow handle 31 for seating spring cartridge 51, it is important to ensure structural integrity and in particular minimize any weakening or material stressing of the inner bow handle 31 which may occur by virtue of having such an opening. Thus, inner bow handle 31 preferably comprises a sturdy steel or hard metal or carbon or aluminum (including aircraft-grade aluminum), but may also comprise the same material as bow 12 in integral fabrication. Bow 12 comprises the usual materials used to construct compound or recurve bows, such as but not limited to woods (usually laminated), fiberglass (generally for bow limbs), carbon fibers, and related composites as are known or may become known in the art. The inner bow handle 31, of course, is integrally joined with the remainder of bow 12 using devices and methods known in the art for joining together different material elements. But, as noted, so long as there is structural integrity notwithstanding its horizontal opening for seating spring cartridge 51 (which drill point may also be engineered out entirely as just discussed), inner bow handle 31 may comprise the same materials as bow 12 in integral fabrication.

To manufacture a bow system 1 which includes this invention, a number of approaches may be employed. If one utilizes the embodiment of FIG. 5 to 9, one key step is to prepare the bow 12 and inner bow handle 31 so as to contain the spring cartridge 51 as shown in FIG. 11. This includes providing the horizontal rear opening and then immovably seating the spring cartridge 51 inside. The optional rotation damper 52 may then be seated over pin 34, and the pin may then be inserted through flexible aperture element 37 and pin aperture 35 (or whatever aperture system one may devise) of outer bow grip 11, see FIG. 7. Finally, the balance of outer bow grip 11 may be fabricated or molded or assembled so as to surround inner bow handle 31 in the manner detailed in FIGS. 5 and 6, using a range of methods that are known in the manufacturing arts. For the variations of FIGS. 14 to 17, one similarly established the spring mechanism on the inner bow handle 31, and then surrounds this with the outer bow grip 11.

Retrofitting of the invention to preexisting bow systems 1 is possible following a similar prescription, but is less desirable than manufacturing the bow system 1 with this invention integral from the start. In particular, it is not to be expected that preexisting bow risers which in applicant's invention need to be employed as inner bow handle 31, will have the necessary cross-sectional characteristics to accommodate the drilling of a horizontal rear opening (see also 141 and 142 in the FIGS. 14 to 17 variations), receive the spring cartridge 51 or other spring mechanism, and then be surrounded by the outer bow grip 11, all while maintaining proper structural integrity. But for any such preexisting bow systems 1 which can be retrofitted in this way, it is to be understood that such retrofitting does fall within the scope of this disclosure and its associated claims.

The use of an outer bow grip 11 and an inner bow handle 31 provides the ability to offer interchangeable grip profiles for the outer bow grip 11, which can satisfy archer style preferences, making it more desirable and cost effective to produce the invention.

Another unique feature of the outer bow grip 11 is its shape, which is radically different from what is customary in the art. For a compound bow in particular, the preferred shape, without limitation, is the aforementioned "teardrop" or "wedge" in which the narrow end faces the archer while the bow is being held. This helps, as discussed already, to maximize the range of rotation when the bow system 1 is in a drawn configuration.

Another advantage of the invention is that the inner bow handle 31 may be made stronger yet still remain narrow at the locale where it seats within outer bow grip 11, which is what most archers have become accustomed to.

The teardrop shape for outer bow grip 11 also promotes a relaxed hand grip by the archer, which is known to be desirable, because the slightly-opened hand naturally assumes this same shape. For this reason, the ergonomic comfort and aiming ability for archer preferring a relaxed grip is not compromised.

For archers who prefer a more traditional, rectangular shaped grip, this can also be achieved so long as the inner bow handle 31 is produced to as to accommodate the rectangular shape. This shape can be customized for individual user preferences and can also be used to provide modular interchangeable profiles.

Because of the foregoing attributes in the various described embodiments and variations, this invention will result is superior accuracy for archers of all skill levels.

The knowledge possessed by someone of ordinary skill in the art at the time of this disclosure, including but not limited to the prior art disclosed with this application, is understood to be part and parcel of this disclosure and is implicitly incorporated by reference herein, even if in the interest of economy express statements about the specific knowledge understood to be possessed by someone of ordinary skill are omitted from this disclosure. While reference may be made in this disclosure to the invention comprising a combination of a plurality of elements, it is also understood that this invention is regarded to comprise combinations which omit or exclude one or more of such elements, even if this omission or exclusion of an element or elements is not expressly stated herein, unless it is expressly stated herein that an element is essential to applicant's combination and cannot be omitted. It is further understood that the related prior art may include elements from which this invention may be distinguished by negative claim limitations, even without any express statement of such negative limitations herein. It is to be understood, between the positive statements of applicant's invention expressly stated herein, and the prior art and knowledge of the prior art by those of ordinary skill which is incorporated herein even if not expressly reproduced here for reasons of economy, that any and all such negative claim limitations supported by the prior art are also considered to be within the scope of this disclosure and its associated claims, even absent any express statement herein about any particular negative claim limitations.

Finally, while only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

I claim:

1. An archery bow system apparatus for reducing bow torque, comprising:

an outer bow grip; and an inner bow handle of a bow aligned with a long vertical axis of a riser of said bow and forming part of said riser, said inner bow handle fully enclosed by a geometric surface of said outer bow grip; wherein:

when said bow system is in an undrawn state, said outer bow grip is prevented from rotating relative to said inner bow handle; and when said bow system is drawn into a drawn state, said outer bow grip is enabled to rotate over a limited angular range relative to said inner bow handle only about a long vertical axis of said bow.

2. The apparatus of claim 1, further comprising:

said outer bow grip comprising a retractable lock system comprising an actuator and a retractable restraining tip, said actuator disposed on a front outside of said outer bow grip and said restraining tip disposed on a rear inside of said outer bow grip; and said inner bow handle comprising a restraining nook for engaging with said retractable restraining tip; wherein:

when said bow system is in said undrawn state and said actuator has been used to extend said restraining tip into engagement with said restraining nook, said outer bow grip is prevented by said engagement from rotating relative to said inner bow handle; and when said bow system is drawn into in said drawn state and said actuator has been used to disengage said restraining tip from said engagement with said restraining nook, said outer bow grip is enabled by said disengagement to rotate over said limited angular range relative to said inner bow handle only about said long vertical axis of said bow.

3. The apparatus of claim 1, further comprising:

at least two spring force apparatuses vertically displaced relative to one another about said long vertical axis of said bow which exert an outward force when compressed from an expanded position thereof and return to said expanded position when said inward compressing is relieved; wherein:

when said bow system is in said undrawn state, said outer bow grip is pressured by said spring force apparatuses into a rearward position relative to said inner bow handle, thereby preventing said outer bow grip from rotating relative to said inner bow handle; and when said bow system is drawn into in said drawn state, pressure from the draw overcomes the pressure from said spring force apparatuses so as to move said outer bow grip into a forward position relative to said inner bow handle, thereby enabling said outer bow grip to rotate over said limited angular range relative to said inner bow handle only about said long vertical axis of said bow.

4. The apparatus of claim 3, wherein when said bow system is released from said drawn state back into said undrawn state thus removing said draw pressure, pressure from said spring force apparatuses return said outer bow grip into said rearward position, such that said outer bow grip returns to being prevented from rotating relative to said inner bow handle.

5. The apparatus of claim 3, wherein:

when said outer bow grip is pressured by said spring force apparatuses into said rearward position relative to said inner bow handle, said outer bow grip and said inner bow handle maintain contact at both front and rear contact positions, thereby preventing said outer bow grip from rotating relative to said inner bow handle; and when said outer bow grip is pressured from said draw into said forward position relative to said inner bow handle, said rear contact positions are maintained but said front contact position is relieved, thereby enabling said outer bow grip to rotate relative to said inner bow handle only about said long vertical axis of said bow.

6. The apparatus of claim 5, further comprising:

said outer bow grip comprising an inner front mating feature; and said inner bow handle comprising a complementary front mating feature for mating with said inner front mating feature; wherein:

when said outer bow grip is pressured by said spring force apparatuses into said rearward position relative to said inner bow handle, the mating of said inner front mating feature with said complementary front mating substantially centers said front contact position.

7. The apparatus of claim 5, further comprising:

said inner bow handle comprising at least two pins vertically displaced relative to one another about said long vertical axis of said bow, heads of which maintain contact with said outer bow grip at said rear contact positions irrespective of whether said bow system is drawn or undrawn; and a compressible rotation damper for causing said pins and thus said outer bow grip to rotate smoothly relative to said inner bow handle only about said long vertical axis of said bow when said front contact position is relieved.

8. The apparatus of claim 3, further comprising:

said inner bow handle comprising at least two rear openings thereof vertically displaced relative to one another about said long vertical axis of said bow;

said spring force apparatuses, seated into said rear openings;

at least two pins vertically displaced relative to one another about said long vertical axis of said bow and seated into said rear openings behind said spring force apparatuses;

forward ends of said pins contacting a rear of said spring force apparatuses such that said spring force apparatuses apply rearward pressure against said pins;

rear ends of said pins protruding from said rear openings and contacting a rear pin pressure socket of said outer bow grip; and said spring force apparatuses having a spring compression strength less than a maximal extension strength of said bow system; wherein:

when said bow system is in said undrawn state, said pins are pressed by said spring force apparatuses into a rearward position with a lesser penetration into and a greater protrusion from said rear openings, such that said outer bow grip is pressured by said spring force apparatuses into said rearward position relative to said inner bow handle to prevent relative rotation of said outer bow grip about said inner bow handle; and when said bow system is drawn into in said drawn state, said pins are pressed by said draw pressure into a forward position to penetrate more deeply into and with a lesser protrusion from said rear openings, such that said outer bow grip is moved by said draw pressure into said forward position relative to said inner bow handle to enable said relative rotation only about said long vertical axis of said bow.

9. The apparatus of claim 3, further comprising:

said inner bow handle comprising said spring force apparatuses rearwardly-disposed thereon;

at least two pins vertically displaced relative to one another about said long vertical axis of said bow connected to said spring force apparatuses such that said spring force apparatuses apply rearward pressure against said pins;

rear ends of said pins contacting a rear pin pressure socket of said outer bow grip; and said spring force apparatuses having a spring compression strength less than a maximal extension strength of said bow system; wherein:

when said bow system is in said undrawn state, said pins are pressed by said spring force apparatuses into a rearward position such that said outer bow grip is pressured by said spring force apparatuses into said rearward position relative to said inner bow handle to prevent relative rotation of said outer bow grip about said inner bow handle; and when said bow system is drawn into in said drawn state, said pins are pressed by said draw pressure into a forward position such that said outer bow grip is moved by said draw pressure into said forward position relative to said inner bow handle to enable said relative rotation only about said long vertical axis of said bow.

10. The apparatus of claim 1, further comprising:

said outer bow grip comprising rotation range limiting surfaces; and said inner bow handle comprising front side surfaces; wherein:

when said outer bow grip enabled to rotate relative to said inner bow handle only about said long vertical axis of said bow, said limited angular range arises from said rotation range limiting surfaces contacting said front side surfaces.

11. The apparatus of claim 1, said outer bow grip comprising a teardrop shape configured to maximize said limited angular range while maintaining structural integrity of said inner bow handle and providing an ergonomic exterior of said outer bow grip.

12. An outer bow grip apparatus for use with an archery bow system, comprising:

a retractable lock system comprising an actuator and a retractable restraining tip;

said actuator disposed on a front outside of said outer bow grip; and said restraining tip disposed on a rear inside of said outer bow grip, wherein:

when a geometric surface of said outer bow grip fully encloses an inner bow handle aligned with a long vertical axis of a riser of said bow which handle forms part of said riser, and when said bow system is drawn into a drawn state, said outer bow grip is enabled to rotate over a limited angular range relative to said inner bow handle only about said long vertical axis of said bow.

13. The apparatus of claim 12, further comprising an inner bow handle of a bow comprising a restraining nook for engaging with said retractable restraining tip, said inner bow handle enclosed by said outer bow grip; wherein:

when said bow system is in said undrawn state and said actuator has been used to extend said restraining tip into engagement with said restraining nook, said outer bow grip is prevented by said engagement from rotating relative to said inner bow handle; and when said bow system is drawn into in said drawn state and said actuator has been used to disengage said restraining tip from said engagement with said restraining nook, said outer bow grip is enabled by said disengagement to rotate over a limited angular range relative to said inner bow handle only about said long vertical axis of said bow.

14. The apparatus of claim 13, wherein said archery outer bow grip apparatus is manufactured as part of said archery bow system, so as to enclose said inner bow handle.

15. The apparatus of claim 13, wherein said archery outer bow grip apparatus is manufactured separately from said archery bow system, and is retrofitted to enclose said inner bow handle.

16. The apparatus of claim 12, wherein said archery outer bow grip apparatus is manufactured as part of said archery bow system.

17. The apparatus of claim 12, wherein said archery outer bow grip apparatus is manufactured separately from, and is retrofitted to enclose an inner bow handle enclosed by said outer bow grip of, said archery bow system.

18. An archery bow riser apparatus comprising:

at least two spring force apparatuses vertically displaced relative to one another about a long vertical axis of a bow which exert an outward force when pressed inward from an expanded position thereof and return to said expanded position when said inward pressing is relieved, rearwardly-disposed thereon;

at least two pins vertically displaced relative to one another about said long vertical axis of said bow connected to said spring force apparatuses such that said spring force apparatuses apply rearward pressure against said pins;

rear ends of said pins disposed to exert force from said spring force apparatuses in a rearward direction; and said spring force apparatuses having a spring compression strength less than a maximal extension strength of an archery bow system with which said bow riser is, or is to be, connected; wherein:

when a portion of said riser is fully enclosed by a geometric surface of an outer bow grip, and when said bow system is drawn into a drawn state, said outer bow grip is enabled to rotate over a limited angular range relative to said riser only about a long vertical axis of said bow.

19. The apparatus of claim 18, further comprising an outer bow grip enclosing said riser such that said rear ends of said pins contact a rear pin pressure socket of said outer bow grip; wherein:

when said bow system is in an undrawn state, said pins are pressed by said spring force apparatuses into a rearward position such that said outer bow grip is pressured by said spring force apparatuses into a rearward position relative to said riser, such that said outer bow grip is prevented from rotating relative to said riser; and when said bow system is drawn into in a drawn state, said pins are pressed by the draw pressure into a forward such that said outer bow grip is moved by said draw pressure into a forward position relative to said riser, such that said outer bow grip is enabled to rotate over a limited angular range relative to said riser only about said long vertical axis of said bow.

20. The apparatus of claim 19, wherein said archery bow riser apparatus is manufactured as part of said archery bow system, and said spring force apparatuses and said outer bow grip are then manufactured into and about said archery bow riser.

21. The apparatus of claim 19, wherein said archery bow riser apparatus is part of a preexisting said archery bow system, and said spring force apparatuses and said outer bow grip are retrofitted into and about said archery bow riser.

22. The apparatus of claim 18:

said archery bow riser apparatus comprising at least two rear openings thereof vertically displaced relative to one another about said long vertical axis of said bow;

said spring force apparatuses seated into said rear openings;

said pins seated into said rear openings behind said spring force apparatuses;

forward ends of said pins contacting a rear of said spring force apparatuses such that said spring force apparatuses apply said rearward pressure against said pins; and said rear ends of said pins protruding from said rear openings.

23. The apparatus of claim 22, further comprising an outer bow grip enclosing said riser such that said rear ends of said pins contact a rear pin pressure socket of said outer bow grip; wherein:

when said bow system is in an undrawn state, said pins are additionally pressed by said spring force apparatuses into said rearward position with a lesser penetration into and a greater protrusion from said rear openings; and when said bow system is drawn into in a drawn state, said pins are additionally pressed by the draw pressure into a forward position to penetrate more deeply into with a lesser protrusion from said rear openings.

24. The apparatus of claim 23, wherein said archery bow riser apparatus is manufactured as part of said archery bow system, and said spring force apparatuses and said outer bow grip are then manufactured into and about said archery bow riser.

25. The apparatus of claim 23, wherein said archery bow riser apparatus is part of a preexisting said archery bow system, and said spring force apparatuses and said outer bow grip are retrofitted into and about said archery bow riser.

26. A method of reducing bow torque when using an archery bow system, comprising:

an archer's front hand engaging an outer bow grip of said bow system and the archer's rear hand engaging a bowstring of said bow system, in an undrawn state of said bow system;

when said bow system is in said undrawn state, preventing said outer bow grip from rotating relative to an inner bow handle of a bow, said inner bow handle aligned with a long vertical axis of a riser of said bow and forming part of said riser and fully enclosed by a geometric surface of said outer bow grip of said bow system; and the archer drawing said bow system into in a drawn state, thereby enabling said outer bow grip to rotate over a limited angular range relative to said inner bow handle only about a long vertical axis of said bow, such that said outer bow grip does so-rotate if the archer's front hand is rotated.

27. The method of claim 26, further comprising:

when said bow system is in said undrawn state, using an actuator disposed on a front outside of said outer bow grip to extend a retractable restraining tip disposed on a rear inside of said outer bow grip of a retractable lock system of said outer bow grip into engagement with a restraining nook of said inner bow handle, thereby preventing said outer bow grip from rotating relative to said inner bow handle;

the archer drawing said bow system into in a drawn state; and the archer using said actuator to retract, i.e., disengage said restraining tip from said engagement with said restraining nook, thereby enabling said outer bow grip to rotate over said limited angular range relative to said inner bow handle only about said long vertical axis of said bow, such that said outer grip does so-rotate if the archer's front hand is rotated.

28. The method of claim 26, further comprising:

when said bow system is in said undrawn state, at least two spring force apparatuses which exert an outward force when pressed inward from an expanded position thereof and return to said expanded position when said inward pressing is relieved of said system, pressuring said outer bow grip into a rearward position relative to an inner bow handle of said system enclosed by said outer bow grip, thereby preventing said outer bow grip from rotating relative to said inner bow handle; and the archer drawing said bow system into in a drawn state, wherein pressure from said draw overcomes the pressure from said spring force apparatuses so as to move said outer bow grip into a forward position relative to said inner bow handle, thereby enabling said outer bow grip to rotate over said limited angular range relative to said inner bow handle only about said long vertical axis of said bow, such that said outer grip does so-rotate if the archer's front hand is rotated.

29. The method of claim 28, further comprising the archer releasing said bow system from said drawn state back into said undrawn state thus removing said draw pressure, wherein pressure from said spring force apparatuses return said outer bow grip into said rearward position, such that said outer bow grip returns to being prevented from rotating relative to said inner bow handle.

30. The method of claim 28, wherein:

said outer bow grip and said inner bow handle maintaining contact at both front and rear contact positions, thereby preventing said outer bow grip from rotating relative to said inner bow handle, when said outer bow grip is pressured by said spring force apparatuses into said rearward position relative to said inner bow handle; and maintaining said rear contact positions but relieving said front contact position, thereby enabling said outer bow grip to rotate relative to said inner bow handle only about said long vertical axis of said bow, when said outer bow grip is pressured from said draw into said forward position relative to said inner bow handle.

31. The method of claim 30, further comprising substantially centering said front contact position by mating an inner front mating feature of said outer bow grip with a complementary front mating feature of said inner bow handle, when said outer bow grip is pressured by said spring force apparatuses into said rearward position relative to said inner bow handle.

32. The method of claim 30, further comprising:

heads of at least two pins of said inner bow handle maintaining contact with said outer bow grip at said rear contact positions irrespective of whether said bow system is drawn or undrawn; and causing said pins and thus said outer bow grip to rotate smoothly relative to said inner bow handle only about said long vertical axis of said bow when said front contact position is relieved, using a compressible rotation damper.

33. The method of claim 28, further comprising:

said spring force apparatuses pressing at least two pins vertically displaced relative to one another about said long vertical axis of said bow and seated behind said spring force apparatus into at least two rear openings of said inner bow handle vertically displaced relative to one another about said long vertical axis of said bow into a rearward position with a lesser penetration into and a greater protrusion from said rear openings, such that said outer bow grip is pressured by said spring force apparatuses into said rearward position relative to said inner bow handle to prevent said relative rotation, when said bow system is in said undrawn state; and said draw pressure pressing said pins into a forward position to penetrate more deeply into and with a lesser protrusion from said rear openings, such that said outer bow grip is moved by said draw pressure into said forward position relative to said inner bow handle to enable said relative rotation only about said long vertical axis of said bow, when said bow system is drawn into in said drawn state; wherein:

forward ends of said pins contact a rear of said spring force apparatuses such that said spring force apparatuses apply rearward pressure against said pins;

rear ends of said pins protruding from said rear openings and contact a rear pin pressure socket of said outer bow grip; and said spring force apparatuses have a spring compression strength less than a maximal extension strength of said bow system.

34. The method of claim 28, further comprising:

said spring force apparatuses pressing at least two pins vertically displaced relative to one another about said long vertical axis of said bow and seated behind said spring force apparatuses rearwardly-disposed upon said inner bow handle such that said outer bow grip is pressured by said spring force apparatuses into said rearward position relative to said inner bow handle to prevent said relative rotation, when said bow system is in said undrawn state; and said draw pressure pressing said pins into a forward position such that said outer bow grip is moved by said draw pressure into said forward position relative to said inner bow handle to enable said relative rotation only about said long vertical axis of said bow, when said bow system is drawn into in said drawn state; wherein:

forward ends of said pins contact a rear of said spring force apparatuses such that said spring force apparatuses apply rearward pressure against said pins;

rear ends of said pins contact a rear pin pressure socket of said outer bow grip; and said spring force apparatuses have a spring compression strength less than a maximal extension strength of said bow system.

35. The method of claim 26, further comprising limiting said angular range by rotation range limiting surfaces of said outer bow grip contacting front side surfaces of said inner bow handle, when said outer bow grip is enabled to rotate relative to said inner bow handle only about said long vertical axis of said bow.

36. The method of claim 26, further comprising maximizing said limited angular range while maintaining structural integrity of said inner bow handle and providing an ergonomic exterior of said outer bow grip by said outer bow grip comprising a teardrop shape configured therefor.

37. The method of claim 26, further comprising manufacturing said archery outer bow grip apparatus as part of said archery bow system.

38. The method of claim 26, further comprising manufacturing said archery outer bow grip apparatus separately from said archery bow system, and retrofitting said archery outer bow grip apparatus to enclose said inner bow handle.

* * * * *